US005616453A

United States Patent [19]

Sekiya et al.

[11] Patent Number: 5,616,453

[45] Date of Patent: Apr. 1, 1997

[54] SILVER HALIDE LIGHT-SENSITIVE COLOR PHOTOGRAPHIC MATERIAL

[75] Inventors: Tadanobu Sekiya; Hideaki Haraga, both of Hino, Japan

[73] Assignee: Konica Corporation, Tokyo, Japan

[21] Appl. No.: 519,343

[22] Filed: Aug. 25, 1995

[30] Foreign Application Priority Data

Aug. 30, 1994 [JP] Japan ..... 6-205597

[51] Int. Cl.[6] ..... G03C 1/46

[52] U.S. Cl. ..... 430/504; 430/506; 430/543; 430/567; 430/569; 430/640

[58] Field of Search ..... 430/504, 506, 430/543, 567, 569, 640

[56] References Cited

U.S. PATENT DOCUMENTS

| | | | |
|---|---|---|---|
| 2,369,929 | 2/1945 | Vittum et al. | 95/6 |
| 2,772,162 | 11/1956 | Salminen et al. | 96/55 |
| 2,895,826 | 7/1959 | Salminen et al. | 96/55 |
| 3,061,433 | 10/1962 | Smith et al. | 96/60 |
| 3,446,622 | 5/1969 | Magagnoli et al. | 96/55 |
| 3,451,820 | 6/1969 | Umberger | 96/100 |
| 3,574,623 | 4/1971 | Williams, Jr. | 96/73 |
| 3,725,067 | 4/1973 | Bailey et al. | 96/56.5 |
| 3,758,308 | 9/1973 | Beavers et al. | 96/100 |
| 3,772,002 | 11/1973 | Ramello | 96/100 |
| 4,022,620 | 5/1977 | Okumura et al. | 96/56.2 |
| 4,080,211 | 3/1978 | Van Paesschen et al. | 96/119 R |
| 4,130,427 | 12/1978 | Monbaliu et al. | 96/56.5 |
| 4,163,670 | 8/1979 | Shiba et al. | 96/74 |
| 4,228,233 | 10/1980 | Yagihara et al. | 430/385 |
| 4,248,962 | 2/1981 | Lau | 430/382 |
| 4,254,212 | 3/1981 | Yagihara et al. | 430/381 |
| 4,283,472 | 8/1981 | Gompf et al. | 430/17 |
| 4,296,199 | 10/1981 | Yagihara et al. | 430/551 |
| 4,310,619 | 1/1982 | Ichijima et al. | 430/387 |
| 4,326,024 | 4/1982 | Kobayashi et al. | 430/557 |
| 4,327,173 | 4/1982 | Aoki et al. | 430/505 |
| 4,333,999 | 6/1982 | Lau | 430/17 |
| 4,334,011 | 6/1982 | Aoki et al. | 430/552 |
| 4,338,393 | 7/1982 | Bailey et al. | 430/386 |
| 4,351,897 | 9/1982 | Aoki et al. | 430/555 |
| 4,366,237 | 12/1982 | Ichijima et al. | 430/505 |
| 4,367,282 | 1/1983 | Yagihara et al. | 430/381 |
| 4,401,752 | 8/1983 | Lau | 430/385 |
| 4,409,320 | 10/1983 | Yagihara et al. | 430/381 |
| 4,411,987 | 10/1983 | Kobayashi et al. | 430/542 |
| 4,427,767 | 1/1984 | Aoki | 430/552 |
| 4,428,961 | 1/1984 | Southgate et al. | 424/274 |
| 4,435,503 | 3/1984 | Mihayashi et al. | 430/548 |
| 4,451,559 | 5/1984 | Sato et al. | 430/552 |
| 4,500,630 | 2/1985 | Sato et al. | 430/386 |
| 4,540,654 | 9/1985 | Sato et al. | 430/381 |
| 4,553,477 | 11/1985 | Witczak | 101/365 |
| 4,556,630 | 12/1985 | Furutachi et al. | 430/372 |
| 4,576,910 | 3/1986 | Hirano et al. | 430/548 |
| 4,690,889 | 9/1987 | Saito et al. | 430/552 |
| 4,775,616 | 10/1988 | Kilminster et al. | 430/552 |
| 4,777,120 | 10/1988 | Lau | 430/359 |
| 4,782,012 | 11/1988 | DeSelms et al. | 430/544 |
| 4,832,275 | 5/1989 | Robertson | 242/71.1 |
| 4,846,418 | 7/1989 | Fairman | 242/71.1 |
| 5,223,871 | 6/1993 | Iwagaki et al. | 354/75 |

FOREIGN PATENT DOCUMENTS

| | | |
|---|---|---|
| 0371338A | 6/1990 | European Pat. Off. . |
| 3-243943A | 10/1991 | Japan . |
| 4-151647A | 5/1992 | Japan . |
| 2222694 | 3/1990 | United Kingdom . |

*Primary Examiner*—Geraldine Letscher
*Attorney, Agent, or Firm*—Finnegan, Henderson, Farabow, Garrett & Dunner, L.L.P.

[57] ABSTRACT

A silver halide color photographic light sensitive material is disclosed, comprising a support having thereon a red-sensitive layer, a green-sensitive layer and a yellow dye-forming blue-sensitive layer, wherein the photographic material satisfies a specified relation, which is concerned with latent image keeping thereof. Further, at least one light-sensitive layer of the photographic material comprises a silver halide emulsion layer containing internally reduction-sensitized silver halide grains.

9 Claims, No Drawings

SILVER HALIDE LIGHT-SENSITIVE COLOR PHOTOGRAPHIC MATERIAL

FIELD OF THE INVENTION

The present invention relates to a silver halide light-sensitive color photographic material. To be more specific the present invention relates to a silver halide color negative photographic material which is capable of reducing loss in printing at the photofinishing laboratory.

BACKGROUND OF THE INVENTION

Recently, with enhancement of sensitivity and image quality of silver halide light-sensitive color photographic material have brought customers of color photographic materials advantages that the chance of blunders in the picture-taking due to blurring has been reduced and chances of shooting have been enlarged. Thus, for example, it became possible to catch a subject with a swift movement, and shooting in a dimly-lit place became possible.

Under such a background situation, it may be said that customer's expectation that the pictures with the best finishing are always obtainable whenever and wherever they feel to record as photographic pictures, has been increasing.

In order to answer such a expectation of customers, various efforts have been made by photo-laboratories so that they can deliver as best prints as possible, However, in view of the yield of very best finished prints, the present status may not be the best, as well as from the ecomomical point of view. Therefore, further improvement in this respect has been demanded.

Various causes has been considered for this. According to the research by the present inventors, it has been revealed that improvement in the color negative films used at the time of picture-takinging would greatly contribute to the improvement in print yield.

That is to say, situations, under which the photographic materials are used, are so various that they are not always provided for use without leaving a long time after manufacture thereof. Depending on the customer it is not unusual that customers use the photographic material after lapse of the term of validity thereof. Further, there is no regular pattern as to the period the customers bring the photographic materials to a photo-finishing laboratory. Therefore, color negative films which are capable of producing prints with enhanced and constant image quality, without reducing print loss or yield even if they are used and processed under different conditions.

In order to answer these demands, technologies for improving the stability such as latent image stability or aging stability have been proposed and known in the art. For example, a method of using a benzthiazolium salt for the purpose of improving the latent image stability is disclosed in Japanese Patent O.P.I. Publication No. 50-94918(1975), and for the enhancement of the aging stability, Japanese Patent O.P.I. Publication Nos. 2-108038(1990) and 3-194540(1991) disclose a method of using an oxidizing agent of silver such as a thiosulfonate. However, these techniques individually cannot be a dominant factor for the improvement of the print yield. Further the target could not be attained even by combining these techniques.

Japanese Patent O.P.I. Publication Nos. 3-235942(1991) and 3-240051(1991) disclose a technique of improving the printing yield by using a core/shell-type silver halide grain emulsion and regulating sensitometric properties thereof. According to this technique, the effect of enhancement in the printing yield was attained in the case where the photographic material is used and processed within the term of validity; however, the effect is still insufficient and a serious problem that the print yield is remarkably lowered especially in the case when the photographic material was left unprocessed for a long time after picture-taking.

SUMMARY OF THE INVENTION

Accordingly, the object of the present invention is to provide a silver halide light-sensitive color photographic material which is capable of enhancing the print yield.

Particularly the object of the present invention is to provide a silver halide light-sensitive color photographic material which is capable of exhibiting a stabilized print yield even when the photographic material is left unprocessed relatively for a long time after completion of picture-taking.

Above-mentioned objects of the present invention have been achieved by the following:

(1) In a silver halide light-sensitive color photographic material comprising a support provided thereon a cyan dye-forming red-sensitive layer, a magenta dye-forming green-sensitive layer and a yellow dye-forming blue-sensitive layer, said silver halide light-sensitive color photographic material is characterized in that parameter (μ) defined below satisfies the following relation (n), when the light-sensitive material is processed after being subjected to treatment (a) or (b) as given below:

$$\mu \leqq 0.05 \qquad \text{(n)}$$

Treatment (a)

1. Storage before Exposure: the light-sensitive material is allowed to stand under environmental conditions of a temperature of 45° C., and a RH (relative humidity) of 40% for three weeks:

2. Exposure for 1/200 second to a light source having a color temperature of 5500° K., through an optical wedge:

3. Storage after exposure: allowed to stand under the conditions of a temperature of 45° C., and RH of 40% for four weeks:

Treatment (b):

1. Exposure for 1/200 to a light-source having a color temperature of 5500° K. through an optical wedge:

Parameter μ

In a range of from an exposure amount of log $E_0$ which gives a density of a minimum density plus 0.15 on each of yellow, magenta and cyan density characteristic curves, i.e., Density-log (Exposure) curve obtained through the above treatment (b), to an exposure amount of log $E_5$, which is an interval of 2.5 log (Exposure) unit, a difference between a density Dbi (i=0, 1, 2, 3, 4, 5) at the point of an exposure amount of log Ei (i=0, 1, 2, 3, 4, 5) taken by an increment of 0.5 log (Exposure) unit and the density Dai (i=0, 1, 2, 3, 4, 5) at the same exposure amount point on the characteristic curves obtained through the above treatment (a) is determined for each of yellow, magenta and cyan colors. In this case, the following three dmentional vector, $$t(i)=(D_{ai}[Y]-D_{bi}[Y],\ D_{ai}[M]-D_{bi}[M],\ D_{ai}[C]-D_{bi[C]})$$

$$(i=0, 1, 2, 3, 4, 5)$$

at the exposure point i, the component of which is the 3 values determined above is presumed.

Herein, the following expression is satisfied.

$$\mu(i)=t(i+1)-t(i)\ (i=0, 1, 2, 3, 4)$$

where a difference vector between the vector t(i) and the vector t(i+1) at the adjacent exposure point is μ(i), wherein i=0, 1, 2, 3, 4. Among these difference vectors, one having a maximum magnitude is expressed as $\mu_{max}$, and the magnitude of $\mu_{max}$ is defined as the parameter μ.

(2) The silver halide light-sensitive color photographic material as described in (1), characterized in that, in at least one of yellow, magenta and cyan characteristic curves (D-log E), a ratio, j(i) of g(i) to h is represented by the following equation (r), $$g(i)=\{D_b(i+1)-D_{bi}\}/\{\log E(i+1)-\log E_i\} \quad (p)$$

$$(i=0, 1, 2, 3, 4)$$

$$h=\{D_{b5}-D_{b0}\}/(\log E_5-\log E_0\} \quad (q)$$

$$j(i)=g(i)/h=1.00\pm0.10 \quad (r)$$

(3) In the silver halide light-sensitive color photographic material comprising a support provided thereon a red-sensitive layer, a green-sensitive layer and a blue-sensitive layer as described in (1) or (2), each light-sensitive layer comprises at least two silver halide emulsion layers, and at least one silver halide emulsion layer contains internally reduction-sensitized silver halide grains, at least another silver halide emulsion layer substantially not containing internally reduction-sensitized silver halide grains.

(4) In the silver halide light-sensitive color photographic material as described in (3), at least one silver halide emulsion layer contains silver halide grains, which have been grown in the presence of gelatin, as a dispersion medium, having an adenine content of 0.2 ppm or less.

DETAILED EXPLANATION OF THE INVENTION

In the present invention, in either case when the light-sensitive material is subjected to treatment (a) or treatment-(b),the light sensitive material, of which coating, drying and aging steps have been completed is used; provided, when a quick-acting hardening agent such as a vinylsulfon-type is used, one of which coating and drying steps have been completed is used. The light-sensitive material to be used should be one of which storage period before exposure is within three months under the conditions of a temperature of 23° C. and a RH of 55%.

Also, in treatments (a) and (b) should be used the same samples with each other with respect to the steps and a period of storage under the conditions as described above.

In the present invention, storage, exposure, processing and sensitometry of the sample are carried out according to the manners given below:(partially in accordance with JIS K-7614-1981).

1. Storage before exposure

The sample is stored for three weeks under conditions of 45° C. (temperature) and 40% (relative humidity), provided that the light-sensitive material should be cut in advance into an appropriate size suitable for exposure through an optical wedge.

2. Exposure (1) Exposure is carried out in the room of which environmental conditions are 20°±5° C. and 60%±10% (relative humidity). The light-sensitive material is subjected to exposure after being allowed to stand under these conditions for one hour or longer. (2) The relative spectral energy distribution of the standard light should be as follows.

| Wavelength (nm) | Relative Spectral Energy(*) |
|---|---|
| 360 | 2 |
| 370 | 8 |
| 380 | 14 |
| 390 | 23 |
| 400 | 45 |
| 410 | 57 |
| 420 | 63 |
| 430 | 62 |
| 440 | 31 |
| 450 | 93 |
| 460 | 97 |
| 470 | 98 |
| 480 | 101 |
| 490 | 97 |
| 500 | 100 |
| 510 | 101 |
| 520 | 100 |
| 530 | 104 |
| 550 | 103 |
| 560 | 100 |
| 570 | 97 |
| 580 | 98 |
| 590 | 90 |
| 600 | 93 |
| 610 | 94 |
| 620 | 92 |
| 630 | 88 |
| 640 | 89 |
| 650 | 86 |
| 660 | 86 |
| 670 | 89 |
| 680 | 85 |
| 690 | 75 |
| 700 | 77 |

(*) The energy at 560 nm is set at a relative value of 100.

(3) Exposure is carried out through an optical wedge, of which variations in spectral trnsmission density in the wavelength range of 360 to 700 nm are 10% or less in a range of less than 400 nm and 5% or less in a range of not less than 400 nm.

(4) Exposure time is 1/200 second.

3. Storage after Exposure

The sample is stored for four weeks under conditions of 40° C. and 20% RH.

4. Processing (1) The light-sensitive material which has been subjected to treatment (a) or (b) is to be allowed to stand under the conditions of 20°±5° C. and 60%±10% RH.

(2) Processing is completed within 30 minutes after exposure in the case of treatment (b) and within from 30 minutes to 6 hours after completion of storage after exposure fin the case of treatment (a).

(3) Processing

| Step | Time | Temperature | Replenishment (*2) |
|---|---|---|---|
| Developing | 3 min. 15 sec. | 38 ± 0.3° C. | 780 cc |
| Bleaching | 45 sec. | 38 ± 2.0° C. | 150 cc |
| Fixing | 1 min. 30 sec. | 38 ± 2.0° C. | 830 cc |
| Stabilizing | 1 min. | 38 ± 5.0° C. | 830 cc |
| Drying | 1 min. | 55 ± 5.0° C. | — |

*The replenishing amount is expressed in terms of cc per $m^2$ of the light-sensitive material.

Compositions of color developing solution, bleaching solution, fixing solution, stabilizing solution and replenishing solutions thereof are as follows:

Developing Solution

| | |
|---|---|
| Water | 800 cc |
| potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxylethyl)aniline sulfate | 4.5 g |
| Diethylenetriaminepentaacetic acid | 3.0 g |
| Potassium hydroxide | 1.2 g |

Add water to make the total volume one liter and adjust pH with potassium hydroxide or 20% sulfric acid at 10.06.

Replenishing solution for Color Developer

| | |
|---|---|
| Water | 800 cc |
| potassium carbonate | 35 g |
| Sodium hydrogencarbonate | 3 g |
| Potassium sulfite | 5 g |
| Sodium bromide | 0.4 g |
| Hydroxylamine sulfate | 3.1 g |
| 4-Amino-3-methyl-N-ethyl-N-(β-hydroxylethyl)aniline sulfate | 6.3 g |
| Diethylenetriaminepentacetic acid | 3.0 g |

Add water to make the total volume one liter and adjust pH with potassium hydroxide or 20% sulfric acid at 10.18.

Bleaching solution

| | |
|---|---|
| Water | 700 cc |
| Ammonium ferric(III)1,3-diaminopropane tetracetate | 125 g |
| Ethylenediaminetetraacetic acid | 2 g |
| Sodium nitrite | 50 g |
| Ammonium bromide | 200 g |
| Acetic acid | 56 g |

Add water to make the total volume 1 liter and adjust pH with ammoniacal water or acetic acid at 4.4

Replenishing Solution for Bleaching Solution

| | |
|---|---|
| Water | 700 cc |
| Ammonium ferric(III)1,3-diaminopropanetetraacetate | 175 g |
| Ethylenediaminetetraacetic acid | 2 g |
| Sodium nitrite | 200 g |
| Acetic acid | 56 g |

After adjusting pH with ammoniacal water or acetic acid at 4.4, and add water to make the total volume 1 liter.

Fixing Solution

| | |
|---|---|
| Water | 800 cc |
| Ammonium thiocyanate | 120 g |
| Ammonium thiosulfate | 150 g |
| Sodium sulfite | 15 g |
| Ethylenediaminetetraacetic acid | 2 g |

After adjusting pH with ammoniacal water or glacial acetic acid at 6.2, add water to make the total volume 1 liter.

Replenishing Solution for Fixing solution

| | |
|---|---|
| Water | 800 cc |
| Ammonium thiocyanate | 150 g |
| Ammonium thiosulfate | 180 g |
| Sodium sulfite | 15 g |
| Ethylenediaminetetraacetic acid | 2 g |

After adjusting pH at 6.2 with ammoniacal water or glacial acetic acid, add water to make the total volume 1 liter.

Stabilizing Solution and the Replenisher thereof

| | |
|---|---|
| Water | 900 cc |
| Paraoctylphenyl polyoxyethylene ether (n = 10) | 2.0 g |
| Dimethylol urea | 0.5 g |
| Hexamethylenetetramine | 0.2 g |
| 1,2-benzisothiaziline-3-one | 0.1 g |
| Siloxane (product of UCC, L-77) | 0.1 g |
| Ammoniacal water | 0.5 cc |

Add water to make the total volume 1 liter, adjust pH with ammoniacal water or 50% sulfric acid at 8.5.

5. Density measurement

A density is expressed in terms of $\log_{10}(\Phi_0\Phi)$; wherein $\Phi_0$ represents a light flux of illumination for measuring a density; $\Phi$ represents a flux of a transmission flux in a portion subject to measurement. Geometrical conditions for the density measurement are subject a parallel flux i the direction of a normal line of the illumination flux. As the control transmission flux, the whole flux transmitted to be duffused in a subaerial space is used and, when using the other methods, a correction are to be carried out by making use of a control density piece. Further, when making a measurement, the surface of an emulsion layer is faced to a photoreceptor side. The densities subject to measurement are the status M densities of blue, green and red, and the spectral characteristics thereof are set to be the values shown in Tables 1 and 2, as the comprehensive characteristics of a light source, an optical system, an optical filter, and a photoreceptor each used in a densitometer.

TABLE 1

Spectral characteristics of status M density (expressed in logarithm and a control peak set at 5.00)

| Wavelength (nm) | Blue | Green | Red |
|---|---|---|---|
| 400 | −0.40 | −6.29 | −55.1 |
| 410 | 2.10 | −5.23 | −52.5 |
| 420 | 4.11 | −4.17 | −49.9 |
| 430 | 4.63 | −3.11 | −47.3 |
| 440 | 4.37 | −2.05 | −44.7 |
| 450 | 5.00 | −0.99 | −42.1 |
| 460 | 4.95 | 0.07 | −39.5 |
| 470 | 4.74 | 1.13 | −36.9 |
| 480 | 4.34 | 2.19 | −34.3 |
| 490 | 3.74 | 3.14 | −31.7 |
| 500 | 2.99 | 3.79 | −29.1 |
| 510 | 1.35 | 4.25 | −26.5 |
| 520 | −0.85 | 4.61 | −23.9 |
| 530 | −3.05 | 4.85 | −21.3 |
| 540 | −5.25 | 4.98 | −18.7 |
| 550 | −7.45 | 4.98 | −16.1 |
| 560 | −9.65 | 4.80 | −13.5 |
| 570 | −11.9 | 4.44 | −10.9 |
| 580 | −14.1 | 3.90 | −8.29 |
| 590 | −16.3 | 3.15 | −5.69 |

TABLE 2

| Wavelength (nm) | Blue | Green | Red |
|---|---|---|---|
| 600 | −18.5 | 2.22 | −3.09 |
| 610 | −20.7 | 1.05 | −0.49 |
| 620 | −22.9 | −0.15 | 2.11 |
| 630 | −25.1 | −1.35 | 4.48 |
| 640 | −27.3 | −2.55 | 5.00 |
| 650 | −2.95 | −3.75 | 4.90 |
| 660 | −31.7 | −4.95 | 4.58 |
| 670 | −33.9 | −6.15 | 4.25 |
| 680 | −36.1 | −7.35 | 3.88 |
| 690 | −38.3 | −8.55 | 3.49 |
| 700 | −4.05 | −9.75 | 3.10 |
| 710 | −42.7 | −10.9 | 2.69 |
| 720 | −44.9 | −12.2 | 2.27 |
| 730 | −47.1 | −13.4 | 1.86 |
| 740 | −49.3 | −14.6 | 1.45 |
| 750 | −51.5 | −15.8 | 1.05 |

A characteristic curve or D-(logE) curve is determined by plotting density values of the samples against common logarithm of exposure (log E) with respect to yellow, magenta and cyan densities, respectively, which are obtained through the storage, exposure, processing and density measurement as mentioned above.

The present invention is characterized in that a parameter μ, which is obtained according to the following procedure is set up and the value of this parameter satisfies an equation (n).

$$\mu \leqq 0.05 \quad \text{(n)}$$

Determination of parameter μ

1. Based on characteristic curves (D-logE curve) with respect to yellow, magenta and cyan densities of the photographic material which is processed after being subjected to treatment (b), minimum densities Dmin (Y), Dmin (M) and Dmin (C) are determined;

2. In the exposure range between $\log E_0$ which gives a density ($d_0$) of Dmin+0.15 and $\log E_5$ which locates ΔlogE= 2.5 from $\log E_0$, exposure amounts of log $E_i$ (i=0,1,2,3,4,5) taken by an increment of 0.5 log E unit are determined for each of yellow, magenta and cyan characteristics curves;

3. On each of cyan, magenta and cyan characteristics curves of the photographic material processed after being subject to treatment (a) or (b), are determined densities of $D_{ai}$ (Y), $D_{ai}$ (Y), $D_{ai}$ (C), $D_{bi}$ (Y), $D_{bi}$ (M) and $D_{bi}$ (C) at the exposure amount log $E_i$ (i=0, 1, 2, 3, 4, and 5), as obtained above.

4. Then, density differences between (a) and (b) at the exposure points i ($D_{ai}$ and $D_{bi}$) are determined with respect to three colors, and a three dimensional vector t(i) having the following components is formulated, $$t(i)=\{D_{ai}(Y)-D_{bi}(Y),\ D_{ai}(M)-D_{bi}(M),\ Dai(C)-D_{bi}(C)\};$$

5. A difference between t(i) at the exposure point i and t(i+1) at the neighboring exposure point (i+1) and a magnitude thereof are expressed as μ(i) and μ(i), respectively. Among these μ(i)s, a maximum magnitude (μ(i)max) thereof is set to be parameter μ

$$\mu(i)=t(i+1)-t(i)$$

$$(i=0, 1, 2, 3, 4)$$

$$\mu=\mu(i)\max$$

The value of this parameter is not greater than 0.05, preferably, from 0.01 to 0.05 and, more preferably, from 0.01 to 0.03. Herein, the smaller the value of μ is, the more excellent is the stability of the light-sensitive material; however, since the light-sensitive material usually contains a natural product as gelatin, so that it is almost impossible to control μ at zero and since when μ is 0.03 or less, print yield is much the same, this value was made a critically preferable value of μ as mentioned above.

Moreover, in the light-sensitive material afore-mentioned in (1), more preferable embodiments are as follows: That is to say, it is preferable that in at least one of yellow, magenta and cyan characteristic curves (D-logE) obtained through the above-mentioned treatment (b), a ratio j(i) of g(i) represented by formula (p) to h represented by formula (q) satisfies formula (r), $$g(i)=\{D_b(i+1)-D_{bi}\}/\{\log E_{(i+1)}-\log E_i\} \quad \text{(p)}$$

$$(i=0, 1, 2, 3, 4)$$

$$h=(D_{b5}-D_{b0})/(\log E_5-\log E_0) \quad \text{(q)}$$

$$j(i)=g(i)/h=1.00\pm0.10 \quad \text{(r)}$$

Further, according to one of more preferable embodiments of the present invention, the relation expressed in (r) is realized in the characteristic curve with respect to magenta color, more preferably with respect to magenta and cyan colors and most preferably, with respect to all yellow, magenta and cyan colors.

In the present invention, when relation expressed in (n) as afore-described is satisfied, effects of the invention are achieved. Further, it is preferable that relation (r) is satisfied.

The light-sensitive material which satisfies the relation (r) can be prepared, for example, by providing a plurality of emulsion layers having the same spectral sensitivity, by appropriately choosing the size of the silver halide grains used in the emulsion, by adjusting the coating weight of silver or coupler in the above-mentioned plural emulsion layers having the same spectral sensitivity, or by incorporating a diffusible DIR coupler in another light-sensitive layer(s). Specifically, it is preferable that, among the plural emulsion layers, the coating weight of coupler is maximum in the lowest-speed layer, and a four-equivalent coupler is more preferable.

The silver halide light-sensitive color photographic material of the present invention can be achieved according to the following technique, i.e., by preparing a silver halide light-sensitive color photographic material which comprises at least one emulsion layer containing silver halide grains which have been internally reduction-sensitizatized and at least another emulsion layer not containing silver halide grains which have been internally reduction-sensitized. It is preferable that, in plural layers having the same spectral sensitivity with each other, the highest speed layer contains silver halide grains internally reduction-sensitized and the lowest speed layer does not substantially contain silver halide grains internally reduction-sensitized. In more preferable embodiment of the invention, a photographic material comprises three silver halide emulsion layers having the same spectral sensitivity and different in speed, in which the high speed and medium speed layers contain silver halide grains internally reduction-sensitized, the low speed layer substantially not containing silver halide grains internally reduction-sensitized. Herein, the term "emulsion layer containing grains which have been internally reduction-sensitized" means that the emulsion layer may contain both grains which have been internally reduction-sensitized and grains which have not been internally reduction-sensitized in combination, and the amount of silver halide grains internally sensitized are present in an amount of 5% or more based on the total coating amount of silver, preferably, 50% or more, still more preferably 80%. based on the total coating amount of silver.

The above-mentioned internal reduction-sensitization can be performed by adding a reducing agent, prior to completion of grain growth, either to a silver halide emulsion or to a solution to be mixed in the process of grain growth. It may also be performed by carrying out ripening or growth of grains at a low pAg of not higher than 7, or at a high pH of not lower than 7. According to one of preferable embodiments of the present invention, it is preferable that these methods are used in combination.

As for the reducing agent which is applicable to the present invention, for example, thiourea dioxide, ascorbic acid or a derivative thereof and a tin(II) salt can be mentioned. As other suitable reducing agents include borane compounds, hydrazine derivatives, formamidine sulfinic acids, silane compounds, amines, polyamines, and sulfites can be mentioned. Amount of addition is in the range between $10^{-2}$ to $10^{-8}$ mol per mol of silver halide. Particularly, to satisfy the relation (n) in the invention, it is preferable to carry out ripening or grain growth under the condition of a pAg of 7 or less, or a pH of 7 or more.

In order to perform low-pAg ripening, a silver salt may be added and a water-soluble silver salt is preferable. As the water-soluble silver salt, silver nitrate is preferable. The pAg at the time of ripening is 7 or below, preferably 6 or below, and, more preferably, 1 to 3. (Herein pAg=−log[$Ag^{+}$].)

High pH ripening can be performed, for example, by adding an alkaline compound to a silver halide emulsion or solution to be mixed in the course of grain growth. As for the alkaline compound, for example, sodium hydroxide, potassium hydroxide, sodium carbonate, potassium carbonate or ammonia can be used. In the method in which ammoniacal silver nitrate is added to form silver halide, alkaline compounds excluding ammonia may preferably be used because the effect of ammonia is lowered.

A silver salt or alkaline compound for the reduction sensitization may be added either at a time, i.e., rushed addition, or it may be added over a period of time. In the case of the latter, the addition can be made either at a constant rate or it may be changed acceleratedly.

Further, they may be added dividedly. The soluble silver salt and/or the soluble halide may be made present in a reaction vessel prior to the addition of the soluble silver salt and/or the soluble halide thereto, or the solution containing the soluble silver salt is mixed with the solution containing the halide and, then, the mixture is added to the reaction vessel. Further, the addition thereof can be made separately from the addition of the soluble silver salt and the soluble halide.

In the preparation of the reduction-sensitized silver halide photographic emulsion according to the present invention, in the case when silver halide crystals are grown from seed grains, ripening under low pAg is carried out after formation of the seed grain, or between the time immediately prior to a step of desalination and a step after completion thereof by adding silver nitrite. It is preferable that the ripening is carried out after desalination of the seed grain by adding silver nitrate. In this case, the ripening temperature of not lower than 40° C. and, preferably, between 50 and 80° C. and the ripening period of more than 30 minutes and, preferably, between 50 and 150 minutes may be employed.

When ripening under high pH is conducted, it is necessary for the grain growth to be performed at least once under pH condition of higher than 7, until 70% of the final volume of the grain is formed. More preferably, the grain growth is carried out at least once at a pH of not less than 7, until the time when 50% with respect to the final volume of the grain at the completion of ripening is formed. It is particularly preferable that the grain growth is carried out at least once at a pH of 8 or more until 40% of the final volume of the grain is formed.

In the reduction-sensitized silver halide photographic emulsion used in the present invention, an oxidizing agent can be used. As for the oxidizing agent, for example, the following compounds are included; hydrogen peroxide and addition product thereof such as $H_2O_2$, $NABO_2$, $Na_4P_2O_7$-$2H_2O_2$ and $2Na_2SO_4$-$H_2O2$-$2H_2O$; peroxy acid salts such as $K_2S_2O_3$, $K_2C_2O_3$, $K_4P_2O_3$, $K_2[Ti(O_2)C_2O_4]$-$3H_2O$; besides those mentioned above, peracetic acid, ozone, iodine, bromine and thiosulfonic acid-type compounds may also be mentioned.

The addition amount of the oxidizing agent used in the present invention can be affected depending on the kind of the reducing agent, condition of the reduction sensitization, timing of addition of the oxidizing agent and conditions thereof, the range between $10^{-2}$ and $10^{-5}$ is generally preferable.

The oxidizing agent may be added optionally at a time during manufacture of the silver halide emulsion. It may be added prior to the addition of the reducing agent.

Moreover, after addition of the oxidizing agent, a reductive substance may be added again for the purpose of neutralizing excess amount of the oxidizing agent. As for the reductive substance, a compound which is capable of reducing the above-mentioned such as sulfinic acid compounds, di- and tri- hydroxyl benzenes, chromans, hydrazines or hydrazides, p-phenylenediamines, aldehydes, aminophenols, enediols, oximes, reductive sugars, phenidones, sulfites and ascorbic acid derivatives can be mentioned. The adition amount of these reductive substances is preferably in a range between $10^{-3}$ and $10^{3}$ mol per mol of the oxidizing agent.

As to the position in the silver halide crystal at which reduction sensitization is exerted, it may be optional as far as it is inside the silver halide crystal, however, the reduction sensitization is carried out before substantial growth of the silver halide crystal reaches 50% by weight of the final crystal. More preferably a reduction sensitization nucleus is located in a portion of 0.1 μm or more, furthermore preferably, 0.2 to 0.3 μm in depth from the grin surface.

In the present invention the term "50% by weight of final crystal" means that the total amount of silver halide grains formed in a solution containing protective colloid, in which growth of the silver halide crystals are performed, is 50%.

In the silver halide light-sensitive photographic material of the present invention, at least one silver halide emulsion layer contains silver halide grains, the growth of which carried out in the presence of gelatinas a dispersion medium, having an adenin content of 0.2 ppm or less.

Gelatin is usually manufactured from collagen, which is the main binding tissue of animals, as is described on pages 122 through 124 of "Basics on photographic Engineering" edited by The Society of Photographic Science and Technology of Japan and published by Corona limited, and as for raw material of photographic gelatin, cow bone(ossein), cow skin(hide) and pig skin can be mentioned and, among these, cow bone and cow skin are popularly used. Moreover as the method of treatment of collagen, there are mainly two types, i.e., acidic treatment and lime treatment. As for gelatin for photographic use, lime treatment is more popular and this is also the case as to the gelatin used in the present invention. For example, in the case where photographic gelatin is manufactured from cow-bone by lime treatment method, it usually undergoes deliming, lime treatment, extraction, gellation and drying processes. The dried cow bone is dipped in a dilute hydrochloric acid solution for deliming treatment for four to eight days and, then, after washing and neutralizing processes, soak the cow skin and the cow bone in a saturated lime water for a few months in order to remove keratin, etc., and through washing and neutralizing processes, extraction (first extraction) is carried out with water of 50° to 60° C. for six to eight hours. Then adding water with 5° to 10° C. higher than that used in the first extraction is added to carry out second and third extraction. After extraction and through filtration, the solution is generally condensed at 60° C. under reduced pressure and, then through cooling and gellation steps gelatin is prepared by drying approximately at 25° C., In the above-mentioned manufacturing method of gelatin used in the present invention, it is preferable to use a hard bone portion of cow bones. Temperature of extraction is fixed at 60° C. or below and after filtration step, is carried out the deionization treatments using both cation and anion exchanging resins.

The temperature for extraction of the gelatin used in the present invention is preferably 55° C. or below and, more preferably, 40° C. or below.

Deionization may be conducted at any step after extracting step of the gelatin; it may preferably be performed after filtration step. As for the ion exchanging resin, for example, —H type or —Na type is preferable as the cation exchanging group, and —OH type or —Cl type as the anion exchanging group can be mentioned, however, the —H type as the cation exchanging group and the —OH type as the anion exchanging are preferable. Amount of ion exchanging resin and time for the ion exchanging treatment are preferably so determined that the ion exchanging treatment may be performed sufficiently and substantially, so that no ionic ingredients are found in the gelatin solution and that pH value of the gelatin solution may becomes approximately between 4.9 and 5.3. Further it is preferable that a treatment with a cationic ion exchanging resin is carried out first. Further, although the pH value of the gelatin solution which has been subjected to the ion exchanging treatment is adjusted by the use of a conventional pH adjusting agent, however, it is preferable for the pH not to be adjusted, in which case the pH of the solution is equal to the iso electric point.

Method for measuring the amount of adenin contained in one gram of gelatin is explained in detail on pages 27 through 28, Item No.29, 7th edition of "Method of Testing Photographic Gelatin" published by Commission on Methods of Testing Photographic Gelatin, and the adenin content in the gelatin used in the present invention can be measured according to the reference.

With respect to the gelatin used in the present invention, the adenin content is 0.2 ppm or less, more preferably, 0.1 ppm or less and, still more preferably, 0.05 ppm or less.

The physical retardance of the gelatin used in the present invention is preferably 60 ppm or more, more preferably 80 ppm or more and, most preferably, 120 ppm or more in terms of the retardance measured by the method of measurement of the physical retardance mentioned below:

The method of measurement of the physical retardance employed in the present invention is given below.

| Solution A | |
|---|---|
| Gelatin for use in experiment | 3.0 g |
| Distilled water | 180 ml |
| 0.1 mol sodium chloride aqueous solution | 3.0 ml |
| Solution B | 3.0 ml |
| 0.1 mol silver nitrate aqueous solution | |

1) Solution A is heated to 60° C. for dissolution and, thereafter, the pH of the solution is adjusted to 6.0 with 0.1 m01 KOH and 0.1 mol $HNO_3$. Then, add distilled water to make the total volume of 200 ml.

2) Put Solution A into a glass beaker, maintained the temperature of the solution at 60° C. and stirred it under a fixed condition. and, then, add Solution B at a time and stirred the mixture under a fixed condition. Herein, for stirring the solutions a shuttlecock stirrer with four wings having a diameter of 40 mm was used at a rotary speed at 300 rpm.

3) Ten minutes after addition of Solution B, generated silver chloride emulsion was taken out and turbidity is measured. For the turbidity measurement, a turbidimeter Model SEP-PT-501D, a product of Mitsubishi Chemical Industries Co. Ltd. with a quartz cell having light length of 1 cm was used.

Since generated silver chloride grains conform to Rayleigh scattering, the following relation is established among diameter of the silver chloride grain (d), light intensity of the incident light (i) and intensity of the transmitted light (I).

$$I/d^3 \propto I/i$$

That is to say, the lower the physical retardance of gelatin is, larger the turbidity is, because Ostwald's ripening progresses and, thus the grains grow up.

Upon selecting the method of measuring the physical retardance of the gelatin used in the present invention, a so-called "PAGI method" may also be employed, however, since, as mentioned on pages 7 through 9 of Japanese Patent O.P.I. Publication No. 3-243943(1991), a good interrelation with properties of an emulsion was not obtained by PAGI's method, so that the above-mentioned method was selected.

Further, functions of the gelatin in the silver halide light-sensitive photographic material having become clearer, not only those items of experimentation designated in the PAGI method but also various other analyzing methods. have come to be applied to gelatin. A technique, in which a gelatin containing predetermined amount of tyrosine, which is one constituent of 18 amino acid residues constituting gelatin, is used as a dispersion medium during the step of grain growth, is disclosed in Japanese Patent O.P.I. Publication Nos. 3-24133(1991) and 5-26045(1993).

Tyrosine is a kind of constitutional amino acids of common proteins and is contained in gelatin.

This is contained only in the telopeptide portion in the terminal chain of the gelatin and there is a tendency that this is lost together with the telopeptide by hydrolysis as the time of treatment is extended, and it is considered that there are lots of photographically active amino acid residues in the terminal chain.

David S. Field describes on pages 23 through 28, Vol. 36(1988) of "The Journal of Photographic Science" that tyrosine has a property of a halogen acceptor and the manner of measurement is also disclosed. The gelatin used in the present invention was measured according to this method.

The gelatin used in the present invention preferably contains 7.0 to 15.0 μmols and, more preferably 9.0 to 11.0 μmols of tyrosine per g of gelatin in the dry state. Herein the term "dry state" denotes the state in which water content of gelatin is zero %.

The term "substantial growth process" of the silver halide grains used in the present invention denotes a process of manufacturing the silver halide emulsion comprising a step of supplying, to an aqueous solution containing a protective colloid (gelatin) in which grain growth is performed, halide ion and silver ion as a water-soluble alkali halide and water-soluble silver salt or as fine particles of silver halide to form silver halide grains. Thus, it ranges from nucleaus grain formation (nucleation) to completion of the growth of grains. Therefore, this does not include any manufacturing steps of the silver halide emulsion after completion of the growth of the silver halide grains such as desalination step.

The completion of nucleation denotes a state under which size and numbers of the nucleus grains are fixed to a constant state.

The silver halide grains used in the present invention are preferably grown from seed grains.

In the present invention, the term "seed grains" means grains which are nucleated, grown up and desalted in a separate batch from the substantial growth, and are, as is generally well known in the art, capable of being made present in the reaction vessel prior to the substantial growth thereof.

Moreover the gelatin used in the present invention is used as a dispersion medium in the substantial growth in order to display the effect of the present invention, and it may also be used during nucleation.

Further, it is generally well known in the art to add, after desalting, an aqueous gelatin solution to the emulsion and, after being sufficiently stirred and emulsified at a fixed temperature for a several tens of minutes, add distilled water to make-up the emulsion. Most advantageously, the gelatin relating to the present invention is used as the dispersion medium at the time of substantial growth.

The gelatin may be used either singly or two or more kinds in combination. When two or more kinds of gelatin is used in combination, the adenin content in the gelatin does not means the individual amounts of adenin contained in the individual kinds of gelatin, but it is essential that the total amount of adenin contained in the gelatin satisfies the requirement as afore-mentioned.

-Light-Sensitive Layer-

The silver halide light-sensitive color photographic material relating to the present invention generally comprises a red-sensitive layer containing a cyan dye-forming coupler, a green-sensitive layer containing a magenta dye-forming coupler and a blue-sensitive layer containing a yellow dye-forming coupler. These respective light-sensitive layers may consist of one single layer or a plurality of layers.

There is no specific limitation as to the order of the layer arrangement in the present invention and a variety of layer arrangments can be employed depending on the objective thereof. For example, there are arranged a red-sensitive layer, a green-sensitive layer and a blue-sensitive layer in this order from the side of the support. Contrary to that, the arrangement consisting of a blue-sensitive layer, a green-sensitive layer and a blue-sensitive layer in this order form the support may be employed.

Further, a layer arrangement, in which a layer having sensitivity in the first spectral region is provided between two layers having sensitivity in the second spectral region which is different from the first, may also be used. Still further, in addition to conventional three light-sensitive layers consisting of a red-sensitive layer, a green-sensitive layer and a blue-sensitive layer, another light-sensitive layer, having sensitivity in the fourth spectral region or more layers having sensitivity in the different spectral regions may also be provided. Such layer structures, as to which four or more layers having sensitivity in different spectral regions, are disclosed, for example, Japanese Patent O.P.I. Publication Nos. 61-34541(1986), 61-201245(1986). 61-198236(1986) and 62-160448(1987).

In this case, the fourth or other light-sensitive layers having different spectral sensitivity may be provided in any position of the multiple-layered structure and they may consist either of a single layer or a plurality of layers.

Various non-light-sensitive layers may be provided either at the uppermost or the lowermost position of the light-sensitive layers or therebetween.

The non-light-sensitive layer may contain a coupler or a DIR-coupler disclosed in Japanese Patent O.P.I. Publication Nos. 61-43748(1986), 59-113438(1984),59-113440(1984), 61-20037(1986) and 61-20038(1986). Further it may also contain an anti-color mixing agent which is conventionally used in the art. Still further the non-light-sensitive layer may be an auxiliary layer such as a filter layer or an intermediate layer as disclosed on page 1002, item VII-K of the Research Disclosure No 308,119.

As for the layer structure which is applicable to the light-sensitive material of the present invention includes conventional layer order, a reverse layer order and a unit structure disclosed on page 1002, item VII-K of the Research Disclosure No. 308,119 can be mentioned.

In the case there are two light-sensitive layers having the same spectral sensitivity, these light-sensitive layers may consist of either the same layers or, as disclosed in West German Patent No. 923,045, they may be formed of double layers consisting of a higher emulsion layer and a lower emulsion layer. In this case, it is usually preferable that the layers are usually so arranged that the sensitivity of the layer located nearer to the support has lower sensitivity. A non-light-sensitive layer may be provided between the respective emulsion layers. Further, as disclosed in Japanese Patent O.P.I. Publication Nos. 57-112751(1982), 62-200350(1987), 62-206541(1987) and 62-206543(1987), the lower-sensitive emulsion layer may be arranged in the further side from the support and the higher sensitive layer is arranged nearer to the support.

As a specific examples, layer structures as given below in the order from further position from the support can be mentioned: i.e., Lower speed blue-sensitive layer (BL)/higher speed blue-sensitive layer (BH)/higher speed green-sensitive layer (GH)/lower speed green-sensitive layer (GL)/higher speed red-sensitive layer (RH)/lower speed red-sensitive layer (RL);

BH/BL/GH/GL/RH/RL and

BH/BL:/GH/GL/RH/RL;

Further, as disclosed in Japanese Patent Publication No. 55-34932(1980), such layer arrangements from the further position from the support as blue-sensitive layer/GH/RH/GL/RL and blue-sensitive layer/GL/RL/GH/RH, as disclosed in Japanese Patent O.P.I. Publication Nos. 56-25738(1981 and 62-63936 (1987) may also be possible.

Still further, as disclosed in Japanese Patent Publication No. 49-15495(1974) such a layer structure that consists of three light-sensitive layers having different spectral sensitivity, each of which consists of three layers having sensitivity to the same spectral region but different light-sensitivity, can be applied. These three layers are so arranged that the layer having highest speed is located at the furthest position; the layer having an intermediate speed at the intermediate position and the layer having the lowest speed is located at the closest position from the support. Still further, as disclosed in Japanese Patent O.P.I. publication No. 59-202464(1984), layers may be so arranged from the further side from the support as to be a silver halide emulsion layer having an intermediate speed, a silver halide emulsion layer having the highest speed and a silver halide emulsion layer having the lowest speed in this order.

In the case where a light-sensitive layer consisting of three layers having different sensitivity is applied the order of these three layer is optional and, for example, a silver halide emulsion layer having the highest speed, a silver halide emulsion layer having the lowest speed and a silver halide emulsion layer having intermediate speed in this order and a silver halide emulsion layer having the lowest speed, a silver halide emulsion layer having intermediate speed and a silver halide emulsion layer having the highest speed in this order may be mentioned. Still further, light-sensitive layers having the same spectral sensitivity may consist of four or more layers. In this case, again, arrangement of the layers is optional.

As mentioned above, a variety of layer structure and arrangements may be selected depending on the objective of the light-sensitive material.

The silver halide emulsion used in the present invention may be prepared with reference to the methods disclosed in, for example, on pages 22 through 23 of the Research Disclosure (RD) Nos. 17,643(December 1978) under the title of "I. Emulsion preparation and types" and Research Disclosure No. 18716 on page 648; "chemie et Phisique photographique, written by p. Grafkides and published by Paul Montel( 1967); "photographic Emulsion Chemistry" , written by G. F. Duffin and published by Focal Press(1966)and "Making and Coating Photographic Emulsion" written by V. L. Zelikman et al and published by Focal Press (1964) can be mentioned.

Mono-disperse emulsions disclosed in U.S. Pat. Nos. 3,574,623 and 3,665,394 and British Patent No. 1,413,748 are also preferable.

In silver halide emulsion used in the silver halide light-sensitive material of the present invention, a variety of photographic additives can be used prior to, during or after physical and chemical ripening steps.

As for compounds used in these steps, for example, those disclosed in the above-mentioned Research Disclosure Nos. 17,643, 18,716 and 308,119 can be mentioned, kinds of compounds and locations of disclosure in these three references are given below:

| [Item] | {RD-308,119} | [RD-17,643] | [RD-18,716] |
|---|---|---|---|
| Chemical Sensitizer | 996, III-A | 23 | 648 |
| Spectral Sensitizer | 996, IV-A-A, B, C, D, H, I, J | 23–24 | 648–9 |
| Super Sensitizer | 996, IV-A-E, J | 23–24 | 648–9 |
| Anti-Foggant | 998, VI | 24–25 | 649 |
| Stabilizer | 998, VI | 24–25 | 649 |
| Anti-staining agent | 1002, VII-I | 25 | 650 |
| Dye Image-Stabilizer | 1001, VII-J | 25 | |
| Whitening Agent | 998, V | 24 | |
| U.V. Absorbent | 1003, VIIIC, XIII-C | 25–26 | |
| Light Absorbent | 1003, VIII | 25–26 | |
| light-Scattering Agent | 1003, VIII | | |
| Filter Dye | 1003, VIII | 25–26 | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant; | 1005, XI | 26–27 | 650 |
| Matting Agent | 1007, XVI | | |
| Developing Agent | 1011, XXB | | |

In the light-sensitive material according to the present invention, for the purpose of restraining deterioration by formaldehyde gas it is preferable to incorporate a compound disclosed in U.S. Pat. Nos. 4,411,987 and 4,435,503, which is capable of reacting with formaldehyde and fix it.

The silver halide emulsion according to the present invention preferably contains silver iodobromide having an average silver iodide content of 4 to 20 mol % and, more preferably. 5 to 15 mol %. The silver halide emulsion according to the present invention may contain silver chloride within an extent which does not jeopardize the objective of the present invention.

In the present invention, in the case where a silver halide emulsion containing silver halide grains prepared so that development specks are formed at a specific point on the surface thereof is used together with another silver halide emulsion containing silver halide grains, as for such silver halide emulsion, one containing silver halide grains of a regular crystal shape such as cubic-, octahedral- or tetradecahedral-shaped grains or irregular crystal shape such as spherical- or tabular- shape grains, one having a crystal defect such as twin planes or any one having a composite crystal habit thereof may be used.

The silver halide grains other than those mentioned above may be either fine particles having an average grain diameter not greater than 0.2 μm or those having their projection area-converted diameter up to 10 μm. Further, they may be either a mono-disperse or poly-disperse emulsions.

In the silver halide light-sensitive color photographic material according to the present invention, a variety of dye-forming couplers can be used.

As for yellow dye-forming couplers, for example, those disclosed in U.S. Pat. Nos. 3,933,051, 4,022,620, 4,326,024, 4,401,752 and 4,248,961; Japanese Pat. Publication No. 58-10739(1983); British Patent Nos. 1,425,020, 4,314,023 and 4,511,649 and European Patent No. 249,473A are preferable.

As for magenta dye-forming couplers, 5-pyrazolon and pyrazoloazole types compounds are preferable, and, particularly, those disclosed in U.S. Pat. Nos. 4,310.619, 4,351,897; European Patent Nos. 73,636; U.S. Pat. Nos. 3,061,4332 and 3,725,067; Research Disclosure No. 24,230(June 1984); Japanese Pat. O.P.I, Publication No. 60-33552(1985); Research Disclosure No. 24,230 (June 1984); Japanese patent O.P.I. Publication Nos. 60-43659(1985), 61-72238(1986), 60-35730(1985),55-118034(1980) and 60-135951(1985) and U.S. Pat. Nos. 4,500,630, 4,540,654 and 4,556,630; and International Patent O.P.I. Publication No. WO-88/04795 are preferable.

As for cyan dye-forming couplers, various phenol- and naphthol-type couplers which are well-known in the art as well as those according to the present invention can be mentioned and, for example those disclosed in U.S. Pat. Nos. 4,228,233, 4,298,200, 2,369,929, 2,810,171, 2,772,162, 2,895,826, 3,772,002, 3,758,308, 4,334,011 and 4,327,173; West German Patent O.L.S. No. 3,323,999; European Patent Nos. 121,365A and 249,453A; U.S. Pat. Nos. 3,446,622, 4,333,999 4,775,616, 4,451,559, 4,427,767, 4,690,889, 4,254,,212 and 4,296,199 and Japanese Patent O.P.I. Publication No. 61-42658(1986) are preferable.

As for colored couplers which are used to in order to compensate unnecessary absorption of the dye-forming coupler, those disclosed in, for example, U.S. Pat. Nos. 4,163,670; Japanese Patent Publication No. 57-39413(1982); U.S. Pat. Nos. 4,004,929 and 4,138,258 and British Patent No. 1,46,368 are preferable. Further it is also preferable to use a coupler which releases a fluorescent dye to correct unnecessary absorption of the dye-forming couplers, as is disclosed in U.S. Pat. No. 4,744,181, and a coupler which is capable of releasing a precursor of a dye as a coupling-off group, as is disclosed in U.S. Pat. No. 4,777,120.

As for dye-forming couplers which have appropriate diffusibility, those disclosed in U.S. Pat. No. 4,366,237; British Patent No. 2,125,570; European patent No. 96,570;and West German Patent O.L.S. Publication No. 3,234,533 can be mentioned.

Typical examples of polymerized dye-forming coupler are disclosed in U.S. Pat. Nos. 3,451,820, 4,080,211, 4,367,282, 4,409,320 and 4,576,910 and British Patent No. 2,102,173.

Couplers which are capable of releasing a photographically useful group can also be used advantageously in the present invention. As for D.I.R. couplers which releases a development inhibitor upon coupling reaction, for example, those disclosed in Japanese Patent O.P.I Publication Nos. 57-151944(1982), 57-154234(1982), 60-184248(1985) and 63-37346 (1988); U.S. Pat. Nos. 4,248,962 and 4,782,012 are preferable.

As for couplers which release a nucleating agent or a development accelerlator, those disclosed in British Patent Nos. 2,097,140 and 2,131,188; Japanese Pat. O.P.I. Publication Nos. 59-157638(1984) and 59-170840(1984) are preferable.

As for couplers which are used in the light-sensitive material other than those mentioned above, for example, a competing coupler disclosed in U.S. Pat. No. 4,130,427; a polyvalent coupler as disclosed in U.S. Pat. Nos. 4,283,472, 4,338,393, and 4,310,427; a DIR redox compound-releasing coupler disclosed in Japanese Patent O.P.I. Publication Nos. 60-185950(1985) and 62-24252(1987); a DIR coupler-releasing coupler; a DIR coupler-releasing redox compound; a DIR redox-releasing redox,; a bleach accelerator-releasing coupler as disclosed in Research Disclosure Nos. 11,449 and 24,241 and Japanese Patent O.P.I. Publication No. 61-201247(1986); a ligand-releasing coupler disclosed in U.S. Pat. No. 4,553,477; and a coupler which releases a leuco dye as disclosed in Japanese Patent O.P.I. Publication No. 63-75747(1988) can be mentioned.

Still further, various kinds of couplers can be employed in the present invention. Specific examples of these couplers are disclosed i Research Disclosure No. 17,643 and 308,119. Relevant portions are cited below:

| Item | [RD-308,119] | [RD-17,643] |
|---|---|---|
| Yellow Dye-Forming Coupler | 1001, VII-D | VII, C–G |
| Magenta Dye-Forming Coupler | 1001, VII-D | VII, C–G |
| Colored Coupler | 1002, VII-G | VII, G |
| DIR Coupler | 1001, VII-F | VII, F |
| BAR Coupler | 1002, VII-F | |
| Other Useful Residue | 1001, VII-F | |
| Alkali-Soluble Coupler | 1001, VII-E | |

Additives used in the present invention can be added using a dispersion technique disclosed in RD No. 308,119, XIV, etc.

-Support-

As for the support used in the silver halide light-sensitive material according to the present invention any optional material which is conventionally known and used in the art can be used. In the case of a transparent support, it is preferable to incorporate a dye in the photographic support in order to prevent light piping phenomenon or edge fogging, which is caused when light comes in from the edge portion of the support on which photographic emulsion layers are provided. As for dyes used for this purpose, there is no specific limitations, however, in view of film-manufacturing steps, dyes having an heat-resistant property are preferable and, for example, anthraquinone-type dyes may be mentioned. As for color used for a transparent support, as usually used in the general light-sensitive materials, gray dye is preferable. The dye may be used either singly or two or more kinds in combination. As specific examples, SUMIPLAST produced by Sumitomo Chemical Industries Co., Ltd., Diaresin produced by Mitsubishi Chemical Industry Co, Ltd. and MACROLEX produced by Beyer can be used either singly or in combination.

The transparent support used in the present invention can be prepared first as non-stretched film by, after sufficiently drying a copolymer composition of polyester comprising the above-mentioned copolymer of polyester and, if necessary, an anti-oxidant and at least one compounmd selected from the group consisting of sodium acetate, sodium hydroxide and tetraethylhydroxyammonium, melting and extruding in the form of film through an extruding machine, which is adjusted at a temperature between 260° and 320° C., and is equipped with a filter and a clasp, subsequently to cool the composition down on a rotary cool drum. Then this non-stretched film is stretched in both longitudinal and lateral directions and is subjected to thermal fixation.

Although the stretching condition of the film may not be determined unconditionally as it can vary depending on the kind and nature of the composition of the copolymer, in the case of the longitudinal direction, at the stretching ratio of 2.5–6.0 at a temperature range between the glass transition temperature(Tg) of the copolymeric polyester and Tg+100 (° C.) and 2.5–4.0 at the temperature range between Tg+5° C. and Tg +50° C. in the case of lateral direction. Thus obtained biaxially stretched film is usually fixed thermally at a temperature between 150° and 240° C. and is, then, cooled. In this case, if necessary. relaxation can be made either in the longitudinal and/or lateral direction.

The transparent support used in the present invention may be constituted by a single sheet or film prepared in the manner mentioned above, or a sheet or film made of a plurality of different sheets or films by co-extrusion method or lamination.

There is no specific limitation as to thickness of the transparent support used in the present invention, however, it is usually 120 μm or less, preferably between 40 and 120 μm and ,more preferably, between 50 and 110 μm. Local fluctuation of the thickness in the transparent support used in the present invention is preferably within 5 μm, more preferably within 4 μm and, still more preferably within 3 μm.

When the fluctuation of the film thickness of the transparent support is within the preferable range mentioned above, there will scarcely be problems of thickness of the film or problems due to curling property of the film in the film after photographic constituent layers are coated and, moreover, it is possible to regulate within the limitation of the total thickness of the light-sensitive material. Further, by regulating the local fluctuation of the film thickness within 5 μm, occurrence of uneven coating or uneven dry may effectively be restrained.

-Subbing layer-

The surface of the transparent support, on which photographic constituent layers are to be formed may be, if necessary, subjected to surface activation treatment such as corona discharge, or provided one or more subbing layers prior to coating of the photographic constituent layers, As for the subbing layer, for example, those subbing layers disclosed in Japanese Patent O.P.I. Publication Nos. 59-19941(1984), 59-77439(1984). 59-224841(1984) and Japanese Patent Publication No. 58-53029(1983) can be mentioned as preferable examples. In the photographic layers, a subbing layer which is provided on the rear surface of the transparent support is also called as a "back Layer".

-Silver halide light-sensitive color photographic material-

According to the present invention can be applied various types of silver halide light-sensitive photographic materials, including, for example, color negative films for general use or cinematography, color reversal films for slide-making and for TV, color paper, color positive film and color reversal paper.

In the case where the silver halide light-sensitive color photographic material according to the present invention is used in the form of a scroll, it is preferable that the light-sensitive material is contained in a cartridge. A cartridge which is most popular in the art is a film parrone in the form of a 135 format. Beside this, cartridges proposed by the following references can also be used.

Japanese Utility Patent O.P.I. Publication No. 58-67329(1983); Japanese Patent O.P.I. Publication Nos. 58-181035(1983) and 58-182634(1983); Japanese Utility Patent O.P.I. Publication No. 58-195236(1983); U.S. Pat. No. 4,221,,479; Japanese Patent Application Nos. 63-57785(1988), 63-183344(1988), 63-325638(1988), 1-25362(1989), 1-21862(1989), 1-30246(1989), 1-20222(1989), 1-21863(1989), 1-37181(1989), 1-33108(1989), 1-85198(1989), 1-172595(1989), 1-172594(1989) and 1-172593(1989); U.S. Pat. Nos. 4,846, 418, 4,848,893 and 4,832,275.

Further, the present invention can be applied to the invention disclosed in the patent application under the title of "A small size photographic roll film cartridge and a film-camera" by Toshihiko Yagi, et al.

In order to obtain a dye image by the use of the silver halide light-sensitive photographic material according to the present invention, color developing process which is well-known in the art can be carried out after imagewise exposure. Also, the silver halide light-sensitive photographic material according to the present invention can be processed by common methods disclosed in, for example, on pages 28 through 29 of the above-mentioned Research Disclosure No. 17,643, on page 647 of Research Disclosure No. 118,718 and XIX of no, 308,119.

EXAMPLES

The present invention is hereinafter further explained with reference to working examples, however, the scope and embodiments of the present invention are not limited by these examples.

Example 1

Preparation of gelatin A

Hard bones of cow, as a raw material, was treated for 60 days in a dispersion solution of slaked lime, and after extract at 36° C., it was treated with a H-type cation-exchange resin and, subsequently, with a OH-type anion-exchange resin, to prepare gelatin-A. The content of adenin of this gelatin was 0.2 ppm.

Preparation of gelatin B

Hard bones of cow, as a raw material, was treated for 60 days in a dispersion solution of slaked lime, and after extract at 70° C., it was treated with a H-type cation-exchange resin and, subsequently, with a OH-type anion-exchange resin, to prepare gelatin-B. The content of adenin of this gelatin was 0.25 ppm.

Results of measurement of the adenin content with respect to the thus obtained gelatin A and gelatin B are shown in Table 3.

TABLE 3

| Gelatin | Extract temperature (°C.) | Ion Exchange treatment | Adenin content (ppm) | Physical retardance (ppm) |
|---|---|---|---|---|
| A | 50 | H—OH | 0.02 | 150 |
| B | 70 | H—OH | 0.25 | 30 |

Preparation of a seed emulsion T-1, which was subjected to low-pAg ripening after desalination An emulsion containing seed grains, which have two parallel twin planes was prepared according to the method shown below:

| | |
|---|---|
| Solution A | |
| Ossein gelatin | 80.0 g |
| Potassium bromide | 47.0 g |
| 10% by weight of methanol solution containing $HO(CH_2CH_2O)m\{CH(CH_3)CH_2O\}_{19.8}(CH_2CH_2O)_nH$ (m + n = 9.7) | 0.48 ml |
| Add water to make the total volume to be 8000.0 ml. | |
| Solution B | |
| Silver nitrite | 1200.0 g |
| Add water to make the total volume to be 1600.0 ml | |
| Ossein gelatin | 32.2 g |
| Solution C | |
| potassium bromide | 790.0 g |
| Potassium iodide | 70.34 g |
| Add water to make the total volume to be 1600 ml. | |
| Solution D | 470.0 ml |
| Ammoniacal water | |

While vigorously agitating Solution A at 40° C., Solution B and Solution C. were added according to the double-jet method, over a period of 7.7 minutes, to form nucleus grains. During the addition, pBr of the solution was maintained at 1.60.

Thereafter temperature was cooled down to 20° C. spending 30 minutes. Then, Solution D was added for one minute and subsequently ripening was carried out for five minutes. The concentrations of potassium bromide and ammonia were 0.03 mol/l and 0.66 mol/l respectively. After completion of ripening, the pH was adjusted to 6.0 and then desalination was carried out by a conventional method.

To the emulsion desalted, 1884 ml of 10% by weight of an aqueous gelatin solution was added and the emulsion was agitated for 15 minutes at 60° C. Then 130 ml of aqueous solution containing 21.0 g of silver nitrite was added, and the pAg of the emulsion was adjusted to 1.9, under which reduction sensitization was carried out. Subsequently thereafter, the emulsion was ripened while stirring for 80 minutes at 60° C. Then 193 ml of aqueous solution containing 14.5 g of potassium bromide was added and after lowering down the temperature of the emulsion to 40° C., was added distilled water to make the total weight of the emulsion to be 5360 g. Electron-microscopic observation of the seed grains contained in the emulsion revealed that the seed grains were spherical shaped grains having two twin surfaces positioned in parallel to each other.

The average grain diameter of this seed grains was 0.217 μm and the proportion of grains having the parallel twin planes was 75% by number with respect to the total number of grains.

Preparation of a seed grain emulsion T-2 which was not subjected to low-pAg ripening after desalination The seed emulsion T-2 was prepared in a manner similar to T-1 during the course up to the desalination and ,after desalination, 10% by weight of aqueous gelatin solution was added and, after dispersing the emulsion under agitation for 30 minutes at 60° C., was added distilled water to make the total weight of the emulsion to be 5360 g.

Preparation of silver halide emulsion Em-1

Using seven solutions as shown below and seed grain emulsion as described above, was prepared an emulsion (Em-1) applicable to the invention, which comprised monodispersed, tabular grains having two parallel twin planes.

| | |
|---|---|
| Solution A | |
| Gelatin A | 67.0 g |
| Distilled water | 3176 ml |
| 10 wt. % methanol solution of $HO(CH_2CH_2O)m$-$\{CH(CH_3)CH_2O\}_{19.8}(CH_2CH_2O)_nH$ (m + n = 9.77) | 2.5 ml |
| Seed grain emulsion (T-1) | 98.51 g |
| Distilled water to make | 3500 ml |
| Solution B | 948 ml |
| 0.5N Silver nitrate aq. solution | |
| Solution c | |
| Potassium bromide | 52.88 g |
| Gelatin A | 35.55 g |
| Distilled water to make | 948 ml |
| Solution D | 4471 ml |
| 3.5N Silver nitrate solution | |
| Solution E | |
| Potassium bromide | 1862.2 g |
| Ossein gelatin | 200 g |
| Distilled water to make | 4471 ml |
| Solution F | 2465.5 g |
| Fine grain emulsion containing gelatin (3 wt. %) and silver iodide fine grains | |

Preparation of the fine grain emulsion is as follows.

To 5000 ml of 6.0 wt. % gelatin solution containing 0.06 mol of potassium iodide, were added 2000 ml aq. solution containing 7.06 mol of silver nitrate and 2000 ml of aq. solution containing 7.06 of potassium iodide over a period of 10 min. During the formation of fine grains, the pH was maintained at 2.0 with nitric acid and the temperature was maintained at 40° C. After the formation, the pH was adjusted to 6.0 with an aq. sodium carbonate solution. Finished weight was 12.53 kg.

Solution G 1.75N Potassium bromide solution

To a reaction vessel was added Solution A, and with vigorous-stirring were added Solutions B through F by double jet method, according to the combination as described in Table 4 to cause seed grains to grow to prepare core/shell type silver halide grain emulsion.

In the table, additions of (1) Solutions B, C. and F, (2) Solutions D, E and F and (3) Solutions D and E were each accelerated so as to conform to the critical growth rate of silver halide grains. Thus, addition rates were optimally controlled so as not to produce fine grains or polydispersed grains due to Ostwald ripening.

The temperature and pAg within the reaction vessel were maintained at 75° C. and 8.8 during the crystal growth. To control the pAg, Solution G was optionally added. A grain diameter and iodide content of silver halide phase constituting the growing surface versus addition time of reaction solutions are shown in Table 4.

After completing the grain growth, the resulting emulsion was subjected to desalting according to the technique as disclosed in Japanese patent OPI No. 5-72658/1993. Adding gelatin thereto, the emulsion was redispersed and the pH and pAg were each adjusted to 5.80 and 8.06. From electronmicrograph of the resulting emulsion, it was proved to be comprised of tabular grains having an average size of 1.22 μm, average aspect ratio of 1.9 and a variation coefficient of grain size of 13.7%.

TABLE 4

| Solution | Time (min) | Grain size (μm) | Iodide (mol %) |
|---|---|---|---|
| (1) B, C, F | 0.00 | 0.217 | 6.0 |
| | 12.50 | 0.318 | 8.4 |
| | 22.83 | 0.370 | 10.8 |
| | 30.98 | 0.410 | 13.2 |
| (2) D, E, F | 30.99 | 0.410 | 13.2 |
| | 52.82 | 0.499 | 20.4 |
| | 76.69 | 0.584 | 30.0 |
| | 122.33 | 0.715 | 30.0 |
| | 150.56 | 0.780 | 30.0 |
| | 150.56 | 0.780 | 20.0 |
| | 176.38 | 0.836 | 20.0 |
| | 187.90 | 0.860 | 12.0 |
| (3) D, E | 187.90 | 0.860 | 0.0 |
| | 210.46 | 0.959 | 0.0 |
| | 224.92 | 1.062 | 0.0 |
| | 233.55 | 1.133 | 0.0 |
| | 243.00 | 1.230 | 0.0 |

Preparation of emulsion Em-2

Comparative emulsion Em-2 was prepared in the same manner as in emulsion Em-1, provided that emulsion T-2 was used, as a seed grain emulsion, in place of T-1.

Preparation of emulsion Em-3

Emulsion Em-3 was prepared in the same manner as in emulsion Em-1, provided that gelatin B was used in place of gelatin A.

Preparation of emulsion Em-4

Emulsion Em-4 was prepared in the same manner as in emulsion Em-2, provided that gelatin b was used in place of gelatin A.

Emulsions Em-1 through 4 are summarized in Table 5.

TABLE 5

| Em No. | Reduction Sensitization | Gelatin used |
|---|---|---|
| Em-1 | Yes | A |
| Em-2 | No | A |
| Em-3 | Yes | B |
| Em-4 | No | B |

Preparation of silver halide color photographic material

Emulsions including Em-1 were further subjected to gold-sulfur sensitization. Using these emulsions, on a cellulose triacetate film support, were coated the following layers having compositions as shown below to prepare a multi-layered color photographic light sensitive material (Sample 101)

In the following descriptions, addition amounts into the silver halide photographic material are denoted as g per $m^2$, unless otherwise noted. With respect to silver halide and colloidal silver, the amounts thereof were converted to those of silver. The amount of a spectral sensitizing dye was represented in terms of mol per mol of silver halide contained in the same layer. Except for Em-1, silver iodobromide emulsions used do not contain internally reduction-sensitized grains and during the grain growth thereof, there was not employed gelatin having an adenine content of more than 0.2 ppm.

| | |
|---|---|
| 1st layer: Antihalation layer | |
| Black colloidal silver | 0.16 |
| UV absorbent (UV-1) | 0.20 |
| High boiling solvent (Oil-1) | 0.16 |
| Gelatin | 1.23 |
| 2nd layer: Interlayer | |
| High boiling solvent (Oil-2) | 0.17 |
| Gelatin | 1.27 |
| 3rd layer: Low speed red-sensitive layer | |
| Silver iodobromide emulsion (av. grain size, 0.38 μm; av. iodide, 8.0 mol %) | 0.50 |
| Silver iodobromide emulsion (av. grain size, 0.27 μm; av. iodide, 2.0 mol %) | 0.21 |
| Sensitizing dye (SD-1) | $2.8 \times 10^{-4}$ |
| Sensitizing dye (SD-2) | $1.9 \times 10^{-4}$ |
| Sensitizing dye (SD-3) | $1.9 \times 10^{-5}$ |
| Sensitizing dye (SD-4) | $1.0 \times 10^{-4}$ |
| Cyan couplwe (C-1) | 0.48 |
| Cyan coupler (C-2) | 0.14 |
| Colored cyan coupler (CC-1) | 0.021 |
| DIR compound (D-1) | 0.020 |
| High boiling solvent (Oil-1) | 0.53 |
| Gelatin | 1.30 |
| 4th layer: Medium speed red-sensitive layer | |
| Silver iodobromide emulsion (av. grain size, 0.52 μm; av. iodide, 8.0 mol %) | 0.62 |
| Silver iodobromide emulsion (av. grain size, 0.38 μm; av. iodide, 8.0 mol %) | 0.27 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan couplwe (C-1) | 0.15 |
| Cyan coupler (C-2) | 0.18 |
| Colored cyan coupler (CC-1) | 0.030 |
| DIR compound (D-1) | 0.013 |
| High boiling solvent (Oil-1) | 0.30 |
| Gelatin | 0.93 |
| 5th layer: High speed red-sensitive layer | |
| Em-1 | |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-5}$ |
| Cyan coupler (C-2) | 0.12 |
| Colored cyan coupler (CC-1) | 0.013 |
| High boiling solvent (Oil-1) | 0.14 |
| Gelatin | 0.80 |
| 6th layer: Interlayer | |
| High boiling solvent (Oil-2) | 0.11 |
| Gelatin | 0.91 |
| 7th layer: Low speed green-sensitive layer | |
| Silver iodobromide emulsion (av. grain size, 0.38 μm; av. iodide, 8.0 mol %) | 0.61 |
| Silver iodobromide emulsion (av. grain size, 0.27 μm; av. iodide, 2.0 mol %) | 0.20 |
| Sensitizing dye (SD-4) | $7.4 \times 10^{-5}$ |
| Sensitizing dye (SD-5) | $6.6 \times 10^{-4}$ |
| Magenta couplwe (M-1) | 0.18 |
| Magenta coupler (M-2) | 0.44 |
| Colored magenta coupler (CM-1) | 0.12 |
| High boiling solvent (Oil-2) | 0.75 |
| Gelatin | 1.95 |
| 8th layer: Medium speed green-sensitive layer | |
| Silver iodobromide emulsion (av. grain size, 0.59 μm; av. iodide, 8.0 mol %) | 0.87 |
| Sensitizing dye (SD-6) | $2.4 \times 10^{-4}$ |
| Sensitizing dye (SD-7) | $2.4 \times 10^{-4}$ |
| Magenta couplwe (M-1) | 0.05 |

-continued

| | |
|---|---|
| Magenta coupler (M-2) | 0.13 |
| Colored magenta coupler (CM-1) | 0.070 |
| DIR compound (D-2) | 0.025 |
| DIR compound (D-3) | 0.002 |
| High boiling solvent (Oil-2) | 0.50 |
| Gelatin | 1.00 |
| 9th layer: High speed green-sensitive layer | |
| Silver iodobromide emulsion (av. grain size, 1.00 μm; av. iodide, 8.0 mol %) | 1.27 |
| Sensitizing dye (SD-6) | $1.8 \times 10^{-4}$ |
| Sensitizing dye (SD-7) | $1.8 \times 10^{-4}$ |
| Magenta couplwe (M-2) | 0.084 |
| Magenta coupler (M-3) | 0.064 |
| Colored magenta coupler (CM-1) | 0.012 |
| High boiling solvent (Oil-1) | 0.27 |
| High boiling solvent (Oil-2) | 0.012 |
| Gelatin | 1.00 |
| 10th layer: Yellow filter layer | |
| Yellow colloidal silver | 0.08 |
| Anti-color stain agent (SC-1) | 0.15 |
| Formalin scavenger (HS-1) | 0.20 |
| High boiling solvent (Oil-2) | 0.19 |
| Gelatin | 1.10 |
| 11th layer: Interlayer | |
| Formalin scavenger (HS-1) | 0.20 |
| Gelatin | 0.60 |
| 12th layer: Low speed blue-sensitive layer | |
| Silver iodobromide emulsion (av. grain size, 0.59 μm; av. iodide, 8.0 mol %) | 0.073 |
| Silver iodobromide emulsion (av. grain size, 0.38 μm; av. iodide, 3.0 mol %) | 0.16 |
| Silver iodobromide emulsion (av. grain size, 0.27 μm; av. iodide, 2.0 mol %) | 0.20 |
| Sensitizing dye (SD-8) | $2.2 \times 10^{-4}$ |
| Sensitizing dye (SD-9) | $2.7 \times 10^{-4}$ |
| Yellow couplwe (Y-1) | 0.89 |
| DIR compound (D-1) | 0.010 |
| High boiling solvent (Oil-2) | 0.30 |
| Gelatin | 1.20 |
| 13th layer: High speed blue-sensitive layer | |
| Em-1 | 0.95 |
| Sensitizing dye (SD-8) | $7.3 \times 10^{-5}$ |
| Sensitizing dye (SD-9) | $2.8 \times 10^{-5}$ |
| Yellow couplwe (Y-1) | 0.11 |
| High boiling solvent (Oil-2) | 0.046 |
| Gelatin | 0.80 |
| 14th layer: First protective layer | |
| Silver iodobromide emulsion (av. grain size, 0.08 μm; av. iodide, 1.0 mol %) | 0.40 |
| UV absorbent (UV-1) | 0.065 |
| UV absorbent (UV-2) | 0.10 |
| High boiling solvent (Oil-1) | 0.07 |
| High boiling solvent (Oil-3) | 0.07 |
| Formalin scavenger (HS-1) | 0.40 |
| Gelatin | 1.31 |
| 14th layer: Second protective layer | |
| Alkali-soluble matting agent (av. 2 μm) | 0.15 |
| polymethyl methaacrylate (av. 3 μm) | 0.04 |
| Sliding agent (WAX-1) | 0.04 |
| Gelatin | 0.55 |

In addition to the composition above-described, were added coating aids Su-1 and 2, thickener V-1, hardeners H-1 and 2, stabilizer ST-1, antifoggant AF-1, dyes AI-1 and 2, AF-2 and antiseptic DI-1 (9.4 mg/m$^2$).

Chemical formulae of compounds as described above are shown below.

C-1
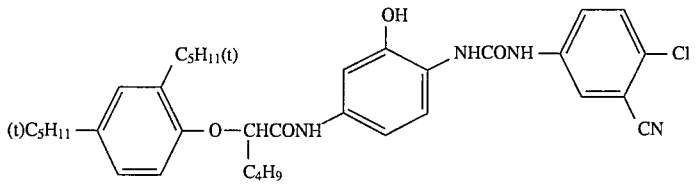
C-2
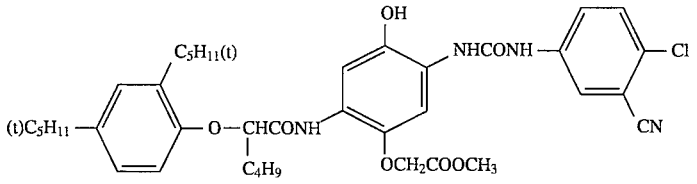
M-1
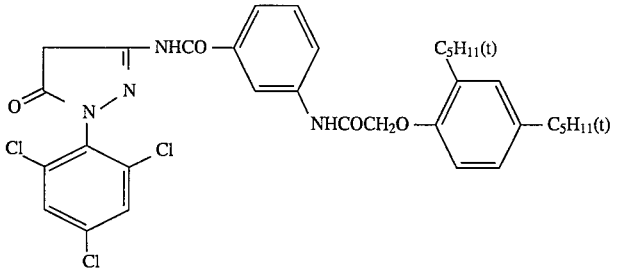
M-2
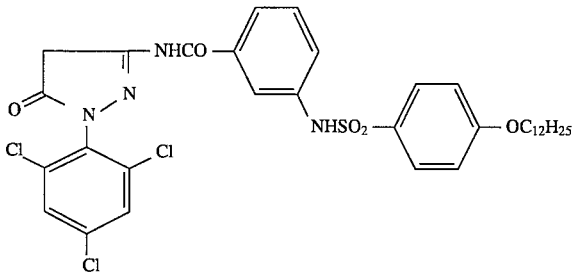
M-3
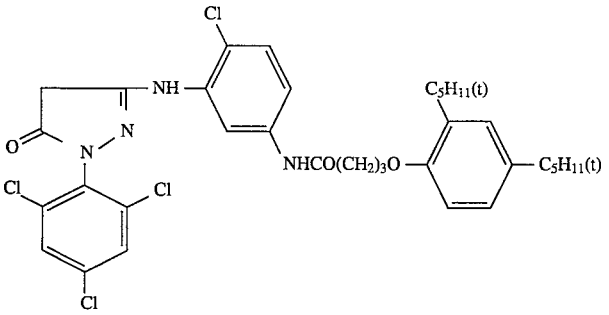
Y-1
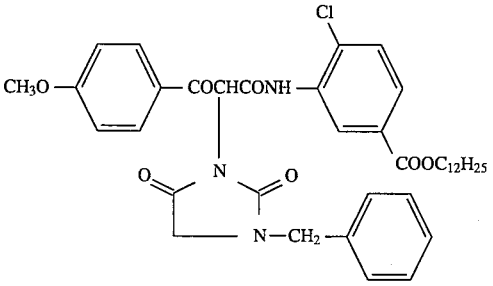

-continued
CC-1
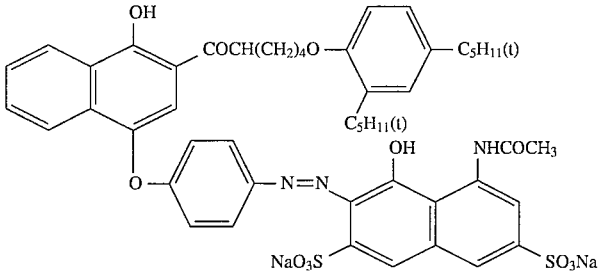
CM-1
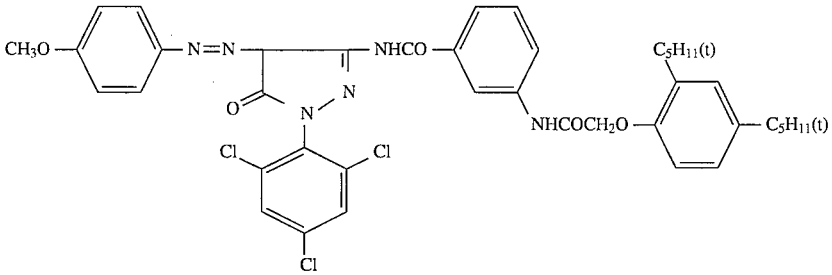
D-1
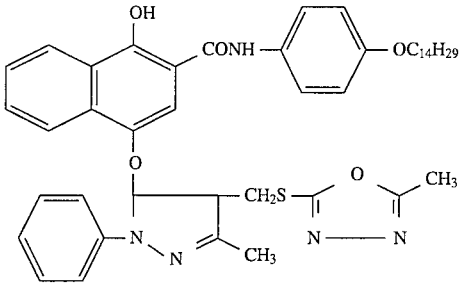
D-2
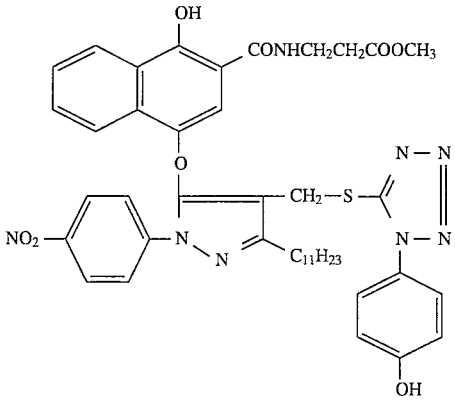
D-3
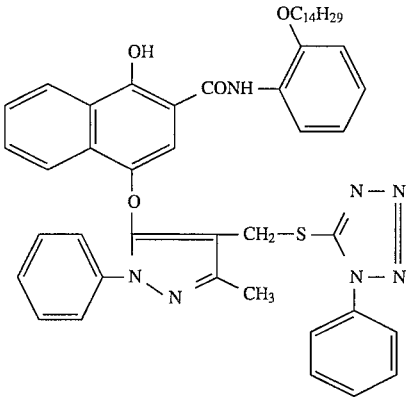
Oil-1
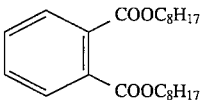
Oil-2
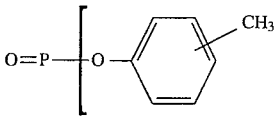
Oil-3
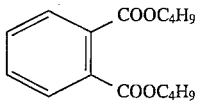
SC-1
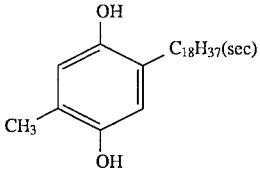
UV-1
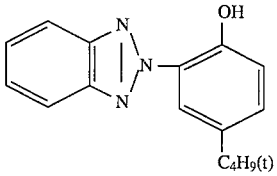

-continued
UV-2
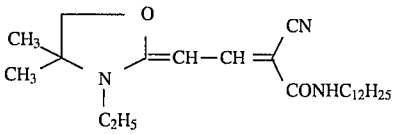
WAX-1
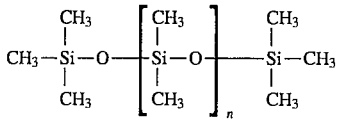
Weight-average molecular weight MW: 3,000
Su-1
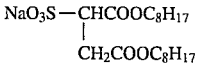
Su-2
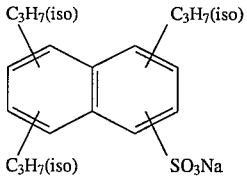
HS-1
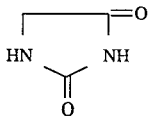
SD-1
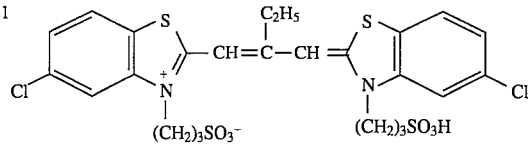
SD-2
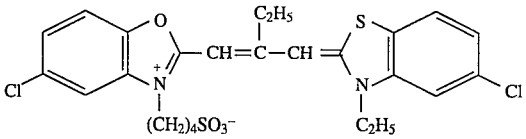
SD-3
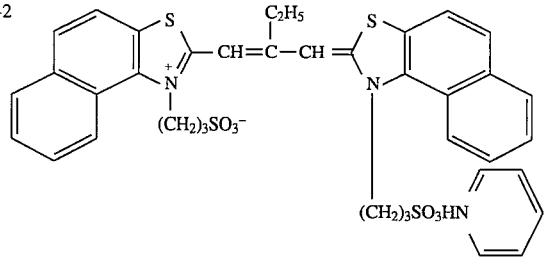
SD-4
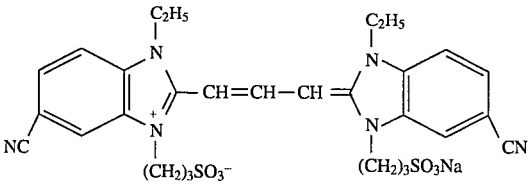
SD-5
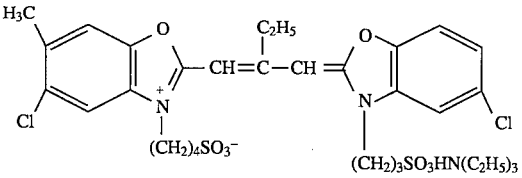
SD-6
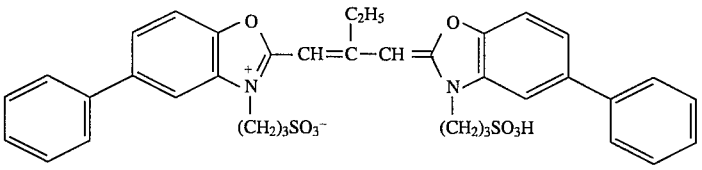
SD-7
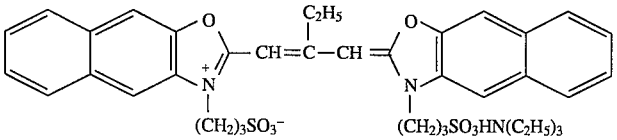
SD-8
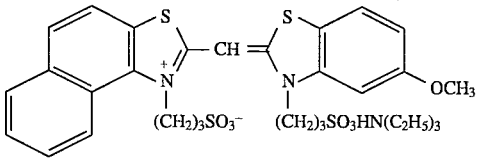
SD-9
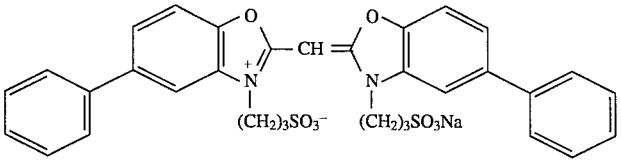

-continued

H-1

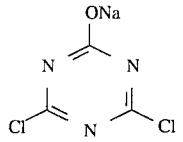

H-2

$(CH_2{=}CHSO_2CH_2)_2O$

ST-1

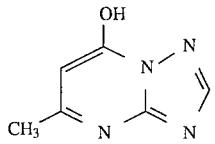

AF-1

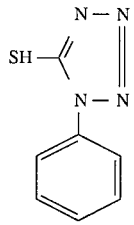

AF-2

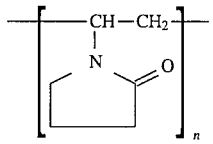

n: Polymerization degree (Mixture comprising the following components)

DI-1

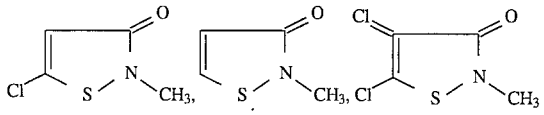

(Component A) (Component B) (Component C)

Component A:B:C = 50:46:4 (mole ratio)

AI-1

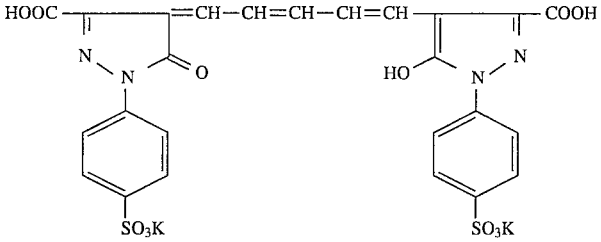

AI-2

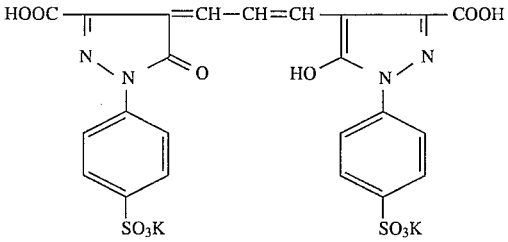

V-1

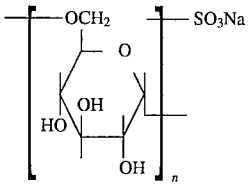

Samples 102 through 110 were prepared in a manner similar to Sample 101, provided that the amount of coupler contained in the 3rd, 7th or 12th layer was changed. Further, as shown in Table 6, compounds 1 or 2 was added to the emulsions used in the 5th or 13th layer at the time of chemical sensitization thereof (Samples 107 to 109).

Compound 1

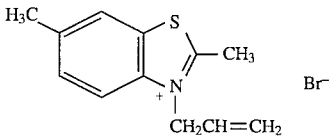

Compound 2

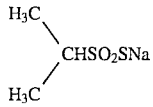

TABLE 6

| Sample | 5th and 13th layers | | | C-1 (3rd | M-2 (7th | Y-1 (12th |
|---|---|---|---|---|---|---|
| No. | Emulsion | Compd 1 | Compd 2 | layer) | layer) | layer) |
| 101 | Em-1 | No | No | 0.48 | 0.44 | 0.89 |
| 102 | Em-2 | No | No | 0.48 | 0.44 | 0.89 |
| 103 | Em-3 | No | No | 0.48 | 0.44 | 0.89 |
| 104 | Em-1 | No | No | 0.53 | 0.44 | 0.98 |
| 105 | Em-1 | No | No | 0.53 | 0.48 | 0.98 |
| 106 | Em-4 | No | No | 0.48 | 0.44 | 0.89 |
| 107 | Em-4 | Yes | No | 0.48 | 0.44 | 0.89 |
| 108 | Em-4 | No | Yes | 0.48 | 0.44 | 0.89 |
| 109 | Em-4 | Yes | Yes | 0.48 | 0.44 | 0.89 |
| 110 | Em-4 | No | No | 0.53 | 0.48 | 0.98 |

Samples thus-prepared were aged at 40° C. and 60% RH for five days and thereafter, parameter (μ) for each sample was determined in the manner as afore-described. Furthermore, values of j(i) at exposure amount points i=0 to 4 on each color chaacteristic curves were determined.

Samples 101 to 110 were loaded in a camera (a film with lens; Torikiri-Konica-Motto-Mini Flash, produced by Konica) to take 200 pictures of the outdoor-scene and person in a fine midday (scene A-1). Photographed samples were processed within 12 hours after being photographed to obtain negative-image films.

Besides the above, Samples 101 to 110 were allowed to stand under the environmental condition of a temperature of 45° C. and 40% RH; thereafter, the samples were each loaded in the camera to take 200 pictures of the outdoor-scene and person in a fine midday (scene A-2) and after further being allowed to stand under the condition of 40° C. and 20% RH, the samples were processed.

Next, using these processed film samples, printing was conducted with printer NPS-1501QA and E-sized prints were obtained by processing with CPK-2 for color paper, both of which were products of Konica Corp. Thus-obtained prints were visually evaluated by employees of Konica as a paneller, based on the the following five grades, with respect to flesh skin tone in from highlight to shadow to estimate an average total-point for scenes A1 and A2. Results thereof are shown in Table 7

5 points: Very healthy tone, preferable reproduction 4 points: Healthy tone, faithful reproduction 3 points: No problem in particular, allowable level 2 points: Slightly unhealthy tone 1 point: Unhealthy tone, non-preferable reproduction

TABLE 7

| | | j (i)* | | | Print evaluation | | |
|---|---|---|---|---|---|---|---|
| Sample | μ | Y | M | C | Scene A1 | Scene A2 | Remarks |
| 101 | 0.02 | 1.05 | 1.02 | 0.98 | 4.53 | 4.46 | Inv |
| 102 | 0.07 | 1.05 | 1.02 | 0.99 | 4.31 | 3.52 | Comp. |
| 103 | 0.05 | 1.04 | 1.03 | 1.01 | 4.47 | 4.37 | Inv. |
| 104 | 0.03 | 1.14 | 1.03 | 1.15 | 4.07 | 4.01 | Inv. |
| 105 | 0.02 | 1.13 | 1.14 | 1.15 | 4.01 | 3.93 | Inv. |
| 106 | 0.10 | 1.04 | 1.02 | 0.98 | 4.37 | 2.26 | Comp. |
| 107 | 0.07 | 1.04 | 1.03 | 0.99 | 4.35 | 2.45 | Comp. |
| 108 | 0.08 | 1.05 | 1.02 | 1.01 | 4.40 | 2.51 | Comp. |
| 109 | 0.07 | 1.04 | 1.03 | 1.01 | 4.38 | 2.55 | Comp. |
| 110 | 0.10 | 1.14 | 1.12 | 1.14 | 3.73 | 1.48 | Comp. |

*A value farthest from 1.00, amont j (i) values (i = 0, 1, 2, 3, 4)

As can be seen from Table 7, inventive samples exhibited little difference in print evaluations due to environmental conditions and a period of time over from preparation, via photographing, to processing and were highly estimated.

Example 2

Preparation of silver halide emulsions Em-5, 6 and 7

A silver iodobromide emulsions Em-5 was prepared in a manner similar to the emulsion Em-1 of Example 1, provided that a seed grain emulsion T-1 was replaced by a seed grain emulsion T-3 , which was reduction-sensitized with thiourea dioxide ($5\times10^{-3}$ mol/mol Ag), in place of low pAg (1.9) ripening. A silver iodobromide emulsion Em-6 was prepared in the same manner as in Em-5, provided that in place of T-3 was used a seed emulsion T-4, which was reduction-sensitized with ascorbic acid ($5\times10^{-3}$ mol/mol Ag).

A silver iodobromide emulsion Em-7 was prepared in a manner similar to emulsion Em-2 of Example 1, provided that prior to desalination, ripening was carried out at a pAg of 2.0 or less.

Photographic material samples 201 202 and 203 were prepared in a manner similar to Sample 101, provided that emulsion Em-1 was replaced by Em-5, Em-6 and Em-7, respectively. Thus prepared samples were evaluated in the same manner as in Example 1, with respect to μ and j(i) values and print-estimation. Results thereof are summarized in Table 8.

TABLE 8

| | | j (i)* | | | Print evaluation | | |
|---|---|---|---|---|---|---|---|
| Sample | μ | Y | M | C | Scene A1 | Scene A2 | Remarks |
| 201 | 0.05 | 1.04 | 1.02 | 0.98 | 4.03 | 3.92 | Inv |
| 202 | 0.06 | 1.05 | 1.02 | 0.99 | 4.00 | 3.26 | Comp. |
| 203 | 0.09 | 1.05 | 1.02 | 0.98 | 4.05 | 2.89 | Comp. |

*A value farthest from 1.00, among j (i) values (i = 0, 1, 2, 3, 4)

As can be seen from the table, silver halide emulsion grains (Em-7), which were surface reduction-sensitized did not result in inventive effects. It is further proved that even if silver halide grains are internally reduction-sensitized, a photographic material, the μ-value of which exceeds 0.05 is not preferable (Sample 202).

Example 3

A photographic material sample 301 was prepared in the same manner as Sample 101 of Example 1, provided that a silver iodobromide emulsion of the 9th layer was replaced by a equivalent weight of emulsion Em-1.

Further, a photographic material sample 302 was prepared in the same manner as Sample 301, provided that silver iodobromide emulsions of the 4th layer were replaced by emulsions Em-8 and Em-9, and a silver iodobromide emulsion of the 8th layer was replaced by emulsion Em-10.

Furthermore, sample 303 was prepared in the same manner as Sample 302, provided that silver iodobromide emulsions of the 3rd layer or the 7the layer were replaced by emulsions Em-9 and Em-11, and silver iodobromide emulsions of the 12th layer were replaced by emulsions Em-10, Em-9 and Em-11. Characteristics of the emulsions Em-8, 9, 10 and 11 are summarized as below.

TABLE 9

| Emulsion | Reduction sensitization | Gelatin | Av. grain size | Iodide content |
|---|---|---|---|---|
| Em-8 | Yes | A | 0.52 (μm) | 8.0 (mol %) |
| Em-9 | Yes | A | 0.38 | 8.0 |
| Em-10 | Yes | A | 0.59 | 8.0 |
| Em-11 | Yes | A | 0.27 | 2.0 |

Thus prepared samples were evaluated in in the same manner as in Example 1, with respect to μ and j(i) values and print-estimation. Results thereof are summarized in Table 10.

TABLE 10

| Sample | μ | j (i)* | | | Print evaluation | | Remarks |
|---|---|---|---|---|---|---|---|
| | | Y | M | C | Scene A1 | Scene A2 | |
| 301 | 0.02 | 1.05 | 1.02 | 0.98 | 4.55 | 4.47 | Inv |
| 302 | 0.01 | 1.04 | 1.02 | 0.98 | 4.67 | 4.54 | Inv. |
| 303 | 0.05 | 1.04 | 1.02 | 0.98 | 4.54 | 4.39 | Inv. |

*A value farthest from 1.00, among j (i) values (i = 0, 1, 2, 3, 4)

As can be seen from the table, it was preferable to use silver halide grains, which were internally reduction sensitized, in the high-speed layer of each red-, green- and blue-sensitive layers. It was further preferable to use silver halide grains internally reduction-sensitized in the high-speed and medium-speed layers and not to use them in the low-speed layer.

What is claimed is:

1. A silver halide color photographic light sensitive material comprising a support having thereon a cyan dye-forming red-sensitive silver halide emulsion layer, a magenta dye-forming green-sensitive silver halide emulsion layer and a yellow dye-forming blue-sensitive silver halide emulsion layer, wherein parameter μ as defined below satisfies the following relation (1), when said photographic material is processed after being subjected to treatment (a) or (b) as specified below:

$$\mu \leqq 0.05 \quad (1)$$

Treatment (a)

1) prior to exposure, a photographic material is aged for 3 weeks under the condition of a temperature of 45° C. and a relative humidity of 40%;

2) exposed, for 1/200 second and through an optical wedge, to light source having a clor temperature of 5500K; and 3) aged for 4 weeks under the condition of a temperature of 40° C. and a relative humidity of 20%;

Treatment (b)

1) the photographic material is exposed, for 1/200 seconds and through an optical wedge, to light source having a color temperature of 5500K;

Definition of parameter μ

1) based on each of yellow, magenta and cyan color density characteristic curves (D-log E) of the photographic material processed after being subjected to treatment (b), are determined yellow, magenta and cyan minimum densities, Dmin (Y), Dmin (M) and Dmin (C);

2) in a range from an exposure amount of log $E_0$ which gives a density of the minimum density+0.15 on each of the characteristic curves to an exposure amount of log $E_5$, exposure amounts of log Ei (i=0, 1, 2, 3, 4 and 5) taken by an increment of 0.5 log E unit are determined for each of yellow, magenta and cyan characteristic curves;

3) densities $D_{ai}$ (Y), $D_{ai}$ (M) and $D_{ai}$ (C), which are densities corresponding to the exposure amount of log $E_i$ on each of yellow, magenta and cyan color density characteristic curves of the color photographic material processed after being subjected to treatment (a) and densities $D_{bi}$ (Y), $D_{bi}$ (M) and $D_{bi}$ (C), which are densities corresponding to the exposure amount of log $E_i$ on each of yellow, magenta and cyan color density characteristic curves of the color photographic material processed after being subjected to treatment (b) are respectively determined;

4) a difference between $D_{ai}$ and $D_{bi}$ is determined with respect to each of yellow, magenta and cyan, and a three dimentional vector t(i) having the diference as a component is expressed as t(i), $$t(i)=\{D_{ai}(Y)-D_{bi}(Y),\ D_{ai}(M)-D_{bi}(M),\ D_{ai}(C)-D_{bi}(C)\}$$

$$(i=0, 1, 2, 3, 4, 5)$$

5) a difference between t(i) and t(i+1) is expressed as μ(i), $$\mu(i)=t(i+1)-t(i)$$

$$(i=0, 1, 2, 3, 4)$$

and among these μ(i)s, a vector having a maximum magnitude is expressed as μ(i)max, the magnitude of which is defined as μand wherein at least one of said red-sensitive layer, green-sensitive layer, and blue-sensitive layer comprises at least two silver halide emulsion layers; one of said two silver halide emulsion layers contains internally reduction-sentized silver halide grains and another silver halide emulsion layer contains substantially no internally reduction-sensitized silver halide grains.

2. The silver halide color photographic material of claim 1, wherein, in at least one of yellow, magenta and cyan characteristic curves of the photographic material processed after subjected to treatment (b), the following relation (2) is satisfied, $$j(i)=g(i)/h=1.00\pm0.10 \quad (2)$$

where g(i) and h are represented by the following relations (3) and (4), $$g(i)=(D_b(i+1)-D_{bi})/(\log E_{i+1}-\log E_i) \quad (3)$$

$$(i=0, 1, 2, 3, 4)$$

$$h=(D_{b5}-D_{b0})/(\log E_5-\log E_0) \quad (4)$$

provided that $D_{bi}$ and $\log E_i$ (i=0, 1, 2, 3, 4) are defined in the same manner as in claim 1.

3. The silver halide color photographic material of claim 1, wherein at least one of said red-sensitive, green-sensitive and blue-sensitive layers comprises at least two silver halide emulsion layers each different in speed from the other, in which a higher speed silver halide emulsion layer contains internally reduction-sensitized silver halide grains and a lower speed silver halide emulsion layer substantially does not contain internally reduction-sensitized silver halide grains.

4. The silver halide color photographic material of claim 1, wherein said internally reduction-sensitized grains contain reduction-sensitization nucleus at a portion in the range of 0.2 to 0.3 μm in depth from the surface of the grains.

5. The silver halide color photographic material of claim 1, wherein said internally reduction-sensitized grains are prepared by a process comprising (i) introducing silver halide seed grains into a reaction vessel and (ii) adding thereto a silver salt and halide salt, in the presence of gelatin as a dispersion medium, to cause the seed grains to grow to form silver halide grains, wherein said seed grains are previously reduction-sensitized or reduction sensitization is carried out during the grain growth of step (ii).

6. The silver halide color photographic material of claim 5, wherein said seed grains are previously reduction-sensitized by ripening with a reducing agent or by ripening at a pH of 7.0 or more or at a pAg of 7.0 or less.

7. The silver halide color photographic material of claim 5, wherein, in step (ii), reduction-sensitization is carried out by ripening with the addition of a reducing agent, or ripening at a pH of 7.0 or more or at a pAg of 7.0 or less until 50% of the total amount of the silver salt has been added.

8. The silver halide color photographic material of claim 5, wherein said gelatin contains adenine in an amount of 0.2 ppm or less, and having physical retardance of 60 ppm or more.

9. The silver halide color photographic material of claim 2, wherein at least one of said red-sensitive layer, green-sensitive layer and blue-sensitive layer satisfies the relation of (2) and comprises a plurality of silver halide emulsion layers different in speed from each other, and wherein a lowest speed silver halide emulsion layer contains a four-equivalent coupler and a total coupler amount contained in said lowest speed silver halide emulsion layer is maximum among the silver halide emulsion layers.

* * * * *